US010120331B2

(12) United States Patent
Nakata et al.

(10) Patent No.: US 10,120,331 B2
(45) Date of Patent: Nov. 6, 2018

(54) ELECTROPHOTOGRAPHIC PHOTOSENSITIVE MEMBER, PROCESS FOR PRODUCING ELECTROPHOTOGRAPHIC PHOTOSENSITIVE MEMBER, AND ELECTROPHOTOGRAPHIC APPARATUS AND PROCESS CARTRIDGE INCLUDING ELECTROPHOTOGRAPHIC PHOTOSENSITIVE MEMBER

(71) Applicant: CANON KABUSHIKI KAISHA, Tokyo (JP)

(72) Inventors: Koichi Nakata, Tokyo (JP); Shinji Takagi, Yokohama (JP); Masaki Nonaka, Toride (JP); Haruki Mori, Ichikawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/614,695

(22) Filed: Jun. 6, 2017

(65) Prior Publication Data

US 2017/0364025 A1 Dec. 21, 2017

(30) Foreign Application Priority Data

Jun. 15, 2016 (JP) ..... 2016-119059

(51) Int. Cl.
*G03G 5/06* (2006.01)
*G03G 5/047* (2006.01)
(Continued)

(52) U.S. Cl.
CPC ..... *G03G 21/18* (2013.01); *G03C 1/49872* (2013.01); *G03G 5/047* (2013.01);
(Continued)

(58) Field of Classification Search
CPC ..... G03G 21/18; G03G 5/047; G03G 13/01; G03G 5/0662; G03C 1/49872; G03C 2001/7635; G03C 2001/7481
See application file for complete search history.

(56) References Cited

U.S. PATENT DOCUMENTS 5,510,218 A 4/1996 Nakata et al.
5,616,442 A 4/1997 Kanemaru et al.
(Continued)

FOREIGN PATENT DOCUMENTS

JP 2001-242656 9/2001
JP 2002-278109 9/2002
(Continued)

OTHER PUBLICATIONS

U.S. Appl. No. 15/483,252, Haruki Mori, filed Apr. 10, 2017.

*Primary Examiner* — Thorl Chea
(74) *Attorney, Agent, or Firm* — Fitzpatrick Cella Harper and Scinto

(57) ABSTRACT

The present invention provides a satisfactory electrophotographic photosensitive member which satisfies wear resistance and electrical properties and further, with which image defects do not occur, a process for producing an electrophotographic photosensitive member, and an electrophotographic apparatus and a process cartridge each including the electrophotographic photosensitive member. The electrophotographic photosensitive member the surface layer of which contains a copolymer of a polymerizable functional group-containing charge transporting substance and a particular polymerizable compound.

19 Claims, 1 Drawing Sheet

(51) Int. Cl.

| | |
|---|---|
| ***G03G 21/18*** | (2006.01) |
| ***G03C 1/498*** | (2006.01) |
| ***G03G 13/01*** | (2006.01) |
| *G03C 1/74* | (2006.01) |
| *G03C 1/76* | (2006.01) |

(52) U.S. Cl.
CPC ..... *G03G 5/0662* (2013.01); *G03G 13/01* (2013.01); *G03C 2001/7481* (2013.01); *G03C 2001/7635* (2013.01)

(56) References Cited

U.S. PATENT DOCUMENTS

| | | | |
|---|---|---|---|
| 5,756,248 | A | 5/1998 | Tanaka et al. |
| 5,837,412 | A | 11/1998 | Suzuki et al. |
| 5,932,383 | A | 8/1999 | Nakata et al. |
| 6,040,100 | A | 3/2000 | Tanaka et al. |
| 6,139,997 | A | 10/2000 | Tanaka et al. |
| 6,218,063 | B1 | 4/2001 | Tanaka et al. |
| 6,270,936 | B1 | 8/2001 | Tanaka et al. |
| 6,492,081 | B2 | 12/2002 | Morikawa et al. |
| 6,562,530 | B2 | 5/2003 | Morikawa et al. |
| 6,806,009 | B2 | 10/2004 | Tanaka et al. |
| 6,815,135 | B2 | 11/2004 | Morikawa et al. |
| 6,835,512 | B2 | 12/2004 | Morikawa et al. |
| 6,913,862 | B2 | 7/2005 | Nakata et al. |
| 6,998,210 | B2 | 2/2006 | Yoshimura et al. |
| 7,022,446 | B2 | 4/2006 | Yoshimura et al. |
| 7,078,140 | B2 | 7/2006 | Yoshimura et al. |
| 7,186,489 | B2 | 3/2007 | Uematsu et al. |
| 7,226,711 | B2 | 6/2007 | Amamiya et al. |
| 7,534,534 | B2 | 5/2009 | Nakata et al. |
| 7,732,113 | B2 | 6/2010 | Nakamura et al. |
| 8,343,699 | B2 | 1/2013 | Nagasaka et al. |
| 8,354,210 | B2 | 1/2013 | Takaki et al. |
| 8,465,889 | B2 | 6/2013 | Sekido et al. |
| 8,524,430 | B2 | 9/2013 | Takagi et al. |
| 8,546,050 | B2 | 10/2013 | Maruyama et al. |
| 8,632,931 | B2 | 1/2014 | Sekido et al. |
| 8,795,936 | B2 | 8/2014 | Sekido et al. |
| 9,316,931 | B2 | 4/2016 | Takagi et al. |
| 9,389,523 | B2 | 7/2016 | Nakata et al. |
| 9,594,318 | B2 | 3/2017 | Nakata et al. |
| 2016/0011529 | A1 | 1/2016 | Kosaka et al. |

FOREIGN PATENT DOCUMENTS

| | | |
|---|---|---|
| JP | 2006-064954 | 3/2006 |
| JP | 2007-279446 | 10/2007 |
| JP | 2012-163758 | 8/2012 |

ELECTROPHOTOGRAPHIC PHOTOSENSITIVE MEMBER, PROCESS FOR PRODUCING ELECTROPHOTOGRAPHIC PHOTOSENSITIVE MEMBER, AND ELECTROPHOTOGRAPHIC APPARATUS AND PROCESS CARTRIDGE INCLUDING ELECTROPHOTOGRAPHIC PHOTOSENSITIVE MEMBER

BACKGROUND OF THE INVENTION

Field of the Invention

The present invention relates to an electrophotographic photosensitive member, a process for producing an electrophotographic photosensitive member, and an electrophotographic apparatus and a process cartridge each including an electrophotographic photosensitive member.

Description of the Related Art

Wear resistance and stability are required for the surface layer of an electrophotographic photosensitive member because a series of electrophotographic processes such as charging, exposure, development, transfer and cleaning are repeatedly applied. Examples of a method for improving the wear resistance include a method in which a curable resin is contained in the surface layer of an electrophotographic photosensitive member. However, when a surface layer having a high wear resistance is provided, the surface layer becomes difficult to wear, thereby making it difficult to renew the surface of the photosensitive member and making it easy to accumulate chemical deterioration or the like.

On the other hand, with respect to a charging unit in an electrophotographic apparatus, systems such as charging accompanied by an electrical discharge, frictional charging and injection charging exist, and the charging system accompanied by an electrical discharge is excellent in uniformity of charging and is widely used. However, the charging accompanied by an electrical discharge generates an activated gas (nitrogen oxide, ozone) and the activated gas is adhered to the surface of an electrophotographic photosensitive member to deteriorate the electrophotographic photosensitive member, thereby causing an image defect in a shape of belt, a so-called black belt, to occur. The black belt means a phenomenon that a density difference in a black belt shape occurs in an output image and is one of the image defects due to memory under a charger. The black belt is a phenomenon that, in a reversal development system, when an electrophotographic apparatus is suspended for several hours after electrophotographic processes are completed, a change in quality occurs during the suspension at a portion of the electrophotographic photosensitive member, the portion facing a charger, and when image formation is restarted, a portion corresponding to the charger in the output image becomes denser than the surrounding portion.

Particularly, an improvement of the black belt has been required in recent years because the generation of the activated gas is increased as the speed of the electrophotographic processes becomes high, and the time for a charging process is shortened by improving the output of a charger.

Japanese Patent Application Laid-Open No. 2001-242656 mentions that invasion of a gas into the surface of a photosensitive layer is inhibited by a particular additive contained in a photosensitive member. Japanese Patent Application Laid-Open No. 2002-278109 describes a technique for improving an image defect by a particular stabilizer contained in a photosensitive member. Japanese Patent Application Laid-Open No. 2006-64954 mentions a method for improving memory, image blurring and the like due to a discharge product by a particular additive contained in a photosensitive layer. Japanese Patent Application Laid-Open No. 2007-279446 and Japanese Patent Application Laid-Open No. 2012-163758 also describe a technique for improving an image defect in a photosensitive member by an additive which has gas resistance, the additive contained in a photosensitive layer. In any of these related arts, the additive or the like does not contain a polymerizable functional group and the improvement of image defects is not achieved together with the durability of the photosensitive member.

SUMMARY OF THE INVENTION

In recent years, advancement in making the durability of an electrophotographic photosensitive member higher has been remarkable, and a demand for improving image defects and the like in the case where a photosensitive member is left to stand in an electrophotographic apparatus for a long time has been increasing. To improve memory in a photosensitive member under a charger, it is required that the surface layer itself of the photosensitive member have characteristics of improving durability and reducing permeability against discharge gas and the like without sacrificing wear resistance.

Image defects such as memory under a charger become noticeable particularly in the case where a surface layer of an electrophotographic photosensitive member is formed to be a cured film having a high strength for the purpose of achieving a high durability.

Accordingly, the present invention is directed to providing: a satisfactory electrophotographic photosensitive member which satisfies wear resistance and anti-gas permeation properties and with which the occurrence of image defects such as memory under a charger is suppressed; a process for producing the electrophotographic photosensitive member; and a process cartridge and an electrophotographic apparatus each including the electrophotographic photosensitive member.

According to one aspect of the present invention, there is provided an electrophotographic photosensitive member comprising: a support; and a photosensitive layer on the support, in which a surface layer of the electrophotographic photosensitive member contains a copolymer of a polymerizable functional group-containing charge transporting substance and a compound represented by the following formula (1).

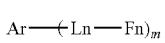

$$Ar\text{—}(Ln\text{—}Fn)_m \quad (1)$$

In formula (1),

Ar represents a substituted or unsubstituted aromatic hydrocarbon group and is an m-valent group derived by eliminating m number of hydrogen atoms each bonded to a benzene ring of a structure represented by formula (2).

Ln represents a divalent group represented by the following formula (3) or the following formula (4).

Fn represents a polymerizable functional group.

m represents an integer of 1 to 4 and when m is equal to or larger than 2, m number of structures in parenthesis may be the same or different.

(2)

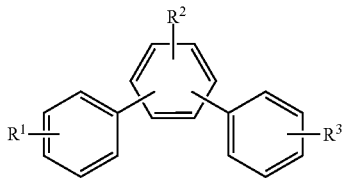

In formula (2), $R^1$, $R^2$ and $R^3$ each independently represent a hydrogen atom or a substituted or unsubstituted phenyl group.

Substituents on Ar, $R^1$, $R^2$ and $R^3$ are each an alkyl group having 1 to 6 carbon atoms or an alkoxy group having 1 to 6 carbon atoms.

(3)

$$-(R^4)_p-$$

(4)

$$-(O-R^5)_r-$$

In formula (3), $R^4$ represents an alkylene group having 1 to 6 carbon atoms and p represents 0 or 1.

In formula (4), $R^5$ represents an alkylene group having 1 to 6 carbon atoms and r represents an integer of 1 to 4.

According to another aspect of the present invention, there is provided a process cartridge integrally supporting: the electrophotographic photosensitive member; and at least one unit selected from the group consisting of a charging unit, a developing unit and a cleaning unit, the process cartridge detachably attachable to an electrophotographic apparatus main body.

According to further aspect of the present invention, there is provided an electrophotographic apparatus including: the electrophotographic photosensitive member; a charging unit; an exposing unit; a developing unit; and a transfer unit.

According to further aspect of the present invention, there is provided a process for producing an electrophotographic photosensitive member including: a support; and a photosensitive layer on the support, the process including polymerizing a coating film of a coating liquid prepared by mixing a polymerizable functional group-containing charge transporting substance and a compound represented by the formula (1), thereby forming a surface layer of the electrophotographic photosensitive member.

As described above, according to the present invention, an electrophotographic photosensitive member having satisfactory electrical properties, wear resistance and memory under a charger, a process for producing the electrophotographic photosensitive member, and a process cartridge and an electrophotographic apparatus each including the electrophotographic photosensitive member can be provided.

Further features of the present invention will become apparent from the following description of exemplary embodiments with reference to the attached drawings.

DESCRIPTION OF THE EMBODIMENTS

Figure 1:
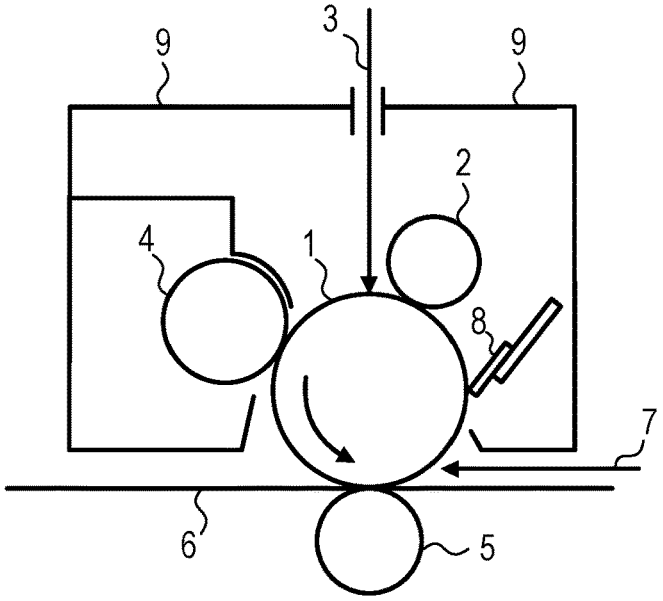
FIG. 1 is a schematic diagram illustrating an example of a process cartridge including an electrophotographic photosensitive member.

Preferred embodiments of the present invention will now be described in detail in accordance with the accompanying drawings.

The present invention relates to an electrophotographic photosensitive member including: a support; and a photosensitive layer on the support, in which a surface layer of the electrophotographic photosensitive member contains a copolymer of a polymerizable functional group-containing charge transporting substance and a compound represented by the following formula (1).

(1)

$$Ar-(Ln-Fn)_m$$

In formula (1),

Ar is a substituted or unsubstituted aromatic hydrocarbon group and is an m-valent group derived by eliminating m number of hydrogen atoms each bonded to a benzene ring of the compound represented by formula (2), Ln represents a divalent group represented by the following formula (3) or the following formula (4), Fn represents a polymerizable functional group and m represents an integer of 1 to 4 and when m is equal to or larger than 2, m number of structures in parenthesis may be the same or different.

(2)

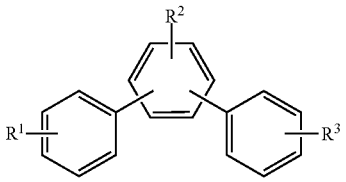

In formula (2), $R^1$, $R^2$ and $R^3$ each independently represent a hydrogen atom or a substituted or unsubstituted phenyl group.

Substituents on Ar, $R^1$, $R^2$ and $R^3$ are each an alkyl group having 1 to 6 carbon atoms or an alkoxy group having 1 to 6 carbon atoms.

(3)

$$-(R^4)_p-$$

(4)

$$-(O-R^5)_r-$$

In formula (3), $R^4$ represents an alkylene group having 1 to 6 carbon atoms and p represents 0 or 1.

In formula (4), $R^5$ represents an alkylene group having 1 to 6 carbon atoms and r represents an integer of 1 to 4.

Further, the present invention relates to the electrophotographic photosensitive member in which the compound represented by the formula (1) is a compound represented by the following formula (5).

(5)

$$Ar-(R^4-Fn)_m$$

In formula (5),

Ar is a substituted or unsubstituted aromatic hydrocarbon group and is an m-valent group derived by eliminating m number of hydrogen atoms each bonded to a benzene ring of the structure represented by the formula (2), Fn represents a polymerizable functional group, $R^4$ represents an alkylene group having 1 to 6 carbon atoms and m represents an integer of 1 to 4 and when m is equal to or larger than 2, m number of structures in parenthesis may be the same or different.

The surface layer of the electrophotographic photosensitive member according to the present invention is formed using a polymerizable functional group-containing charge transporting substance and a particular aromatic group-containing polymerizable compound in combination and forming a film therefrom.

It is considered that the particular aromatic group-containing polymerizable compound according to the present invention exhibits an effect of suppressing penetration of a discharge gas generated in a charger or the like into a photosensitive member. The curable surface layer of the surface of the photosensitive member is considered to have fine voids due to a change in stress or the like in a fine region accompanying hardening reaction.

The discharge gas or the like is considered to penetrate from the surface of the photosensitive member through the fine voids and gradually changes the characteristics of the photosensitive member, so that image defects near a charger occurs. It is considered that the particular aromatic group-containing polymerizable compound according to the present invention can fill the fine voids moderately to exhibit an effect of intercepting the penetration of the discharge gas or the like from the surface of the photosensitive member.

The aromatic hydrocarbon group represented by Ar in the formula (1) is considered to have such a function and is selected from among the groups having an oligophenyl structure, such as various kinds of terphenyl, quaterphenyl and quinquephenyl groups. Assembly of benzene rings, the assembly having a moderate size to the voids, is suitable. The assembly should be constituted by a structure in which only benzene rings, which are not too large, are bonded through a single bond to make the size suitable. The size is preferably 3 or more and 6 or less in terms of the number of benzene rings, particularly preferably 3 or 4.

That is, the structure of the central skeleton, which is represented by Ar in the formula (I) of the polymerizable compound according to the present invention, can be a terphenyl structure in which 3 benzene rings are bonded through a single bond or a quaterphenyl structure in which 4 benzene rings are bonded through a single bond.

Among terphenyls, m-terphenyl or o-terphenyl whose molecular shape bends is preferable. Among the quaterphenyl structures, a quaterphenyl structure having a structure in which one phenyl group is bonded to m-terphenyl or one phenyl group is bonded to an o-terphenyl structure, the quaterphenyl structure having flexibility in the molecular shape, is preferable.

The molecule having a bent structure has a low symmetry and can have various conformations. Among these conformations, further preferably, the skeleton structure can be a structure having a melting point of 120° C. or lower. Although the actual melting point of the polymerizable compound according to the present invention is different from the melting point of the skeleton structure, the melting point in terms of the skeleton structure can be low in order to exhibit the effects of the present application. There is a tendency that when a plurality of conformations are mixed in these oligophenyl compounds, the melting point is lowered. Particularly preferred oligophenyl structures, the structures represented by structural formulas Ar-1 to Ar-6 are shown in Table 1 below.

TABLE 1

Preferred oligophenyl structures

| | Name | Structure | Melting point (measured value) |
|---|---|---|---|
| Ar-1 | m-Terphenyl | 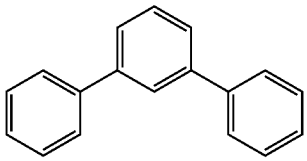 | 87° C. |
| Ar-2 | o-Terphenyl | 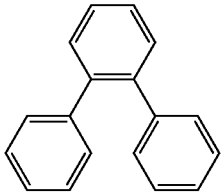 | 56.2° C. |
| Ar-3 | m-Quaterphenyl | 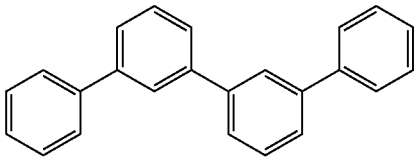 | 86° C. |

TABLE 1-continued

| Preferred oligophenyl structures | | | |
|---|---|---|---|
| | Name | Structure | Melting point (measured value) |
| Ar-4 | o,m-Quaterphenyl | 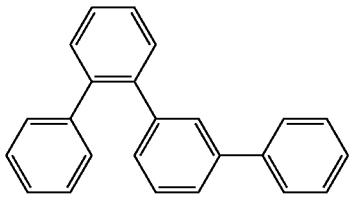 | 91° C. |
| Ar-5 | o,p-Quaterphenyl | 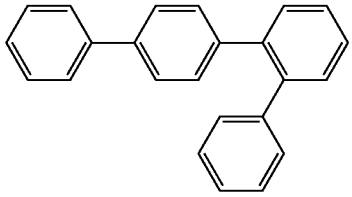 | 118° C. |
| Ar-6 | o-Quaterphenyl | 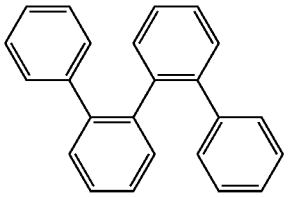 | 119° C. |

The reason that these structures are suitable has not been made perfectly clear; however, the reason is considered as follows. It is considered that the voids and the like in a film-formed structure do not necessarily have a fixed shape and amorphous voids are mixed in various forms. When the amorphous voids are assumed to be keyholes, a filler that fills the keyholes can also have various shapes. It is inferred that an oligophenyl compound having various conformations becomes a key-shaped filler and can fill the voids in the surface layer. Therefore, among the oligophenyl compounds, oligophenyl compounds having a flexible structure are more suitable.

That is, when 3 benzene rings are bonded, the positional relation of the three can be in an m-position or an o-position. When 4 benzene rings are bonded, a m-terphenyl or o-terphenyl structure can be included in a structure.

In contrast, p-terphenyl or p-quaterphenyl in which all the benzene rings are bonded at p-positions has limited configuration forms and therefore is not so adequate from the standpoint described above.

On the other hand, even a bent structure has only one kind of conformation and has a rigid structure when a ring structure such as the structure in triphenylene is formed, and therefore effects of the present invention are not exhibited.

The polymerizable compound according to the present invention may have an alkyl group and an alkoxy group as substituents. It is considered that these substituents have a role of fine adjustment when the voids are filled and of adjusting compatibility or the like. Therefore, these substituents cannot be too large and can be introduced arbitrarily as necessary. The size of the alkyl group and the alkoxy group is preferably 1 to 6 in terms of the number of carbon atoms, more preferably 1 to 4 in terms of the number of carbon atoms.

The polymerizable compound according to the present invention contains a polymerizable functional group and can contain Ln that is a connecting group so that an appropriate distance can be taken between Ar that is the main structure and a polymerizable functional group Fn in the formula (1) to allow the polymerization reaction to occur efficiently in a film-forming and curing process. Ln can be an alkylene group or an oxyalkylene group. When the structure of Ln becomes too long, the film strength and electrical properties are lowered and in contrast, when the structure of Ln is too short, polymerizability and the like are lowered. The number of carbon atoms is preferably 1 to 6, more preferably 2 to 5.

A polymerizable functional group is introduced into the polymerizable compound according to the present invention. With respect to the position where the polymerizable functional group is introduced, the polymerizable functional group is introduced by substituting a hydrogen atom that is bonded to a carbon atom of a benzene ring contained in Ar represented in the formula (1).

The benzene ring as described here may be a benzene ring moiety of the structure represented by formula (2), the structure being the partial structure in the formula (1) or may be a benzene ring of $R^1$, $R^2$ and $R^3$ in the case where $R^1$, $R^2$ and $R^3$, which are bonded to the benzene ring of the structure represented by formula (2) as substituents, are each a phenyl group.

The hydrogen atom may be a hydrogen atom at any position in the structure represented by Ar; however, preferably, the structure can be a structure in which one polymerizable functional group is introduced to one benzene ring. Further, the structure is more preferably a benzene ring that is positioned at an end of conjunct oligophenyl structures.

When the number m of the polymerizable functional groups introduced in the formula (1) increases, the strength of a film formed is improved. However, when the number m becomes too large, the contraction and change in stress accompanying polymerization reaction become large and when the number m is small, the film strength may be lowered. Accordingly, the number m of the polymerizable functional groups can be 2 or 3 in view of the balance between improvement in film strength and decrease in change in stress.

The polymerizable functional group as described in the present specification means a functional group through which molecules can be bonded by a covalent bond when reaction occurs between molecules each having a polymerizable functional group. Examples of the functional group include reactive functional groups described below. The polymerizable compound according to the present invention may have different reactive functional groups within a molecular or between molecules.

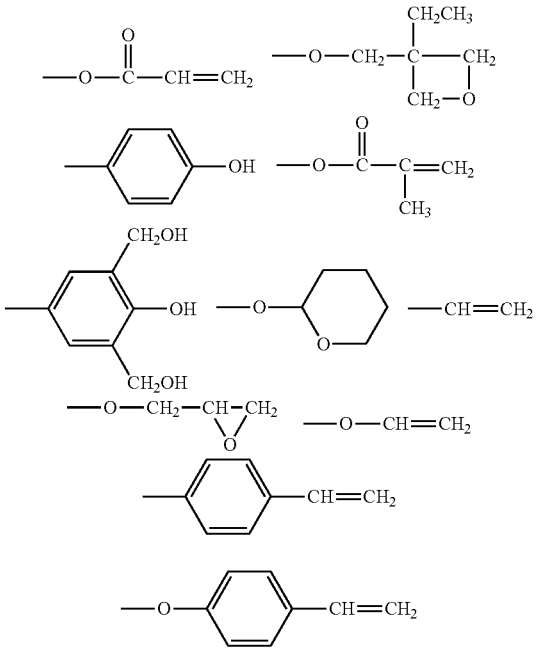

As the polymerizable functional group, an acryloyloxy group, a methacryloyloxy group, an epoxy group, an oxetanyl group, a styryl group and a methylolated phenol group are preferable from the standpoint of the film strength and wear resistance of the surface layer of an electrophotographic photosensitive member.

The acryloyloxy group and the methacryloyloxy group which are each a chain polymerizable functional group are particularly preferable from the standpoint of polymerization properties, polymerization rate and the like.

As a method for polymerizing the polymerizable functional group, a method of applying energy such as an ultraviolet ray, an electron beam and heat or a method of allowing an auxiliary material such as a polymerization initiator, and a compound such as an acid, an alkali and a complex to coexist can be used.

The polymerizable compound according to the present invention is a compound represented by the formula (1) to the formula (4). Specific structures are described below.

$R^4$ and $R^5$ in formulas (3) and (4) each represent a straight or branched alkylene group having 1 to 6 carbon atoms. Examples of the alkylene group include a methylene group, an ethylene group, a n-propylene group, a 1-methylethylene group, a 2-methylethylene group, a n-butylene group, a 1,1-dimethylethylene group, a 1,2-dimethylethylene group, a 2,2-dimethylethylene group, a 1-ethylethylene group, a n-pentylene group, a 1-methylbutylene group, a 2-methylbutylene group, a 3-methylbutylene group, a 4-methylbutylene group, a 1,2-dimethylpropylene group, a 1,3-dimethylpropylene group, a 2-ethylpropylene group, a n-hexylene group, a 1,1-dimethylbutylene group, a 2,2-dimethylbutylene group, a 3,3-dimethylbutylene group, a 4,4-dimethylbutylene group, a 1,2-dimethylbutylene group, a 1,3-dimethylbutylene group, a 1,4-dimethylbutylene group, a 2,3-dimethylbutylene group, a 2,4-dimethylbutylene group, a 3,4-dimethylbutylene group, a 1-ethylbutylene group, a 2-ethylbutylene group, a 3-ethylbutylene group and a 4-ethylbutylene group.

Substituents that Ar and $R^1$, $R^2$ and $R^3$ in formulas (1) and (2) can contain will be described in detail.

Examples of the alkyl group include a methyl group, an ethyl group, a n-propyl group, an isopropyl group, a n-butyl group, an isobutyl group, a sec-butyl group, a tert-butyl group, a n-pentyl group, an isopentyl group, a neopentyl group, a tert-pentyl group, a cyclopentyl group, a n-hexyl group, a 1-methylpentyl group, a 4-methyl-2-pentyl group, a 3,3-dimethylbutyl group, a 2-ethylbutyl group and a cyclohexyl group.

Examples of the alkoxy group include a methoxy group, an ethoxy group, a n-propoxy group, an isopropoxy group, a n-butoxy group, an isobutoxy group, a sec-butoxy group, a tert-butoxy group, a n-pentyloxy group and a n-hexyloxy group.

In the polymerizable compound for use in the surface layer, the ratio of the mass of the compound represented by the formula (1) according to the present invention to the total mass of the polymerizable functional group-containing charge transporting substance and the compound represented by the formula (1) according to the present invention is preferably 5% by mass or more and 70% by mass or less. When the amount of the compound represented by the formula (1) according to the present invention is too small, the effects of the present invention become small, and when the amount is too large, the concentration of the charge transporting substance in the surface layer becomes too small and electrical properties as an electrophotographic photosensitive member are deteriorated. The ratio is more preferably 20% by mass or more and 50% by mass or less.

With respect to a suitable value as the molecular weight of the polymerizable compound according to the present invention, a compound having a molecular weight of 400 or higher and 700 or lower is preferable. When the molecular weight is in the range, it is considered that the effect of filling the fine voids in the surface layer is improved. Moreover, solubility and film-forming properties required in a coating process can be obtained.

Examples of the compound as the charge transporting substance according to the present invention are described below. However, the present invention is not limited to these compounds. The reactive functional groups in the following illustrative compounds No. 1 to No. 64 may be substituted with any of the reactive functional groups described above. The substituents may also be substituted with the substituents described above.

No. 1
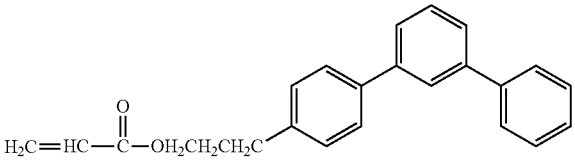
No. 2
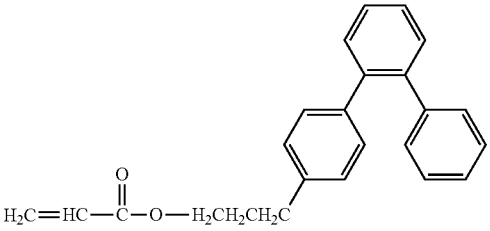
No. 3
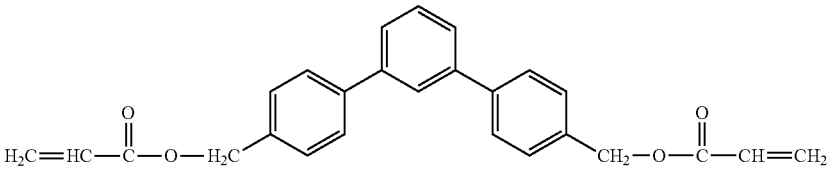
No. 4
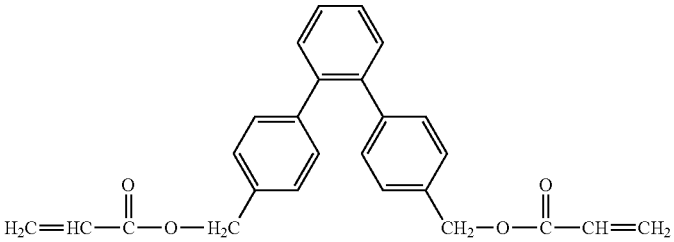
No. 5
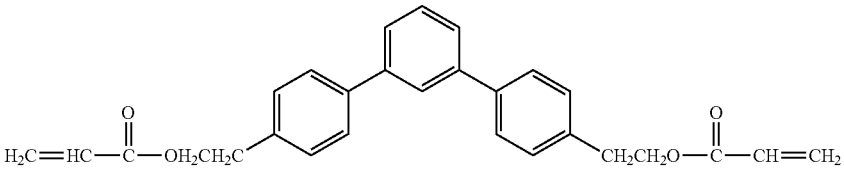
No. 6
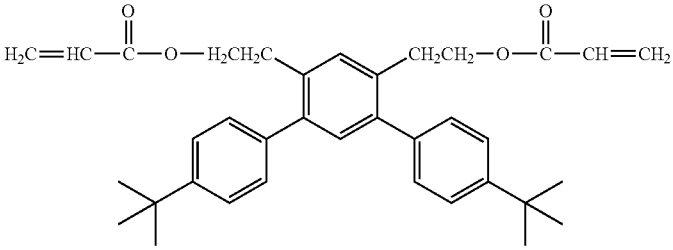
No. 7
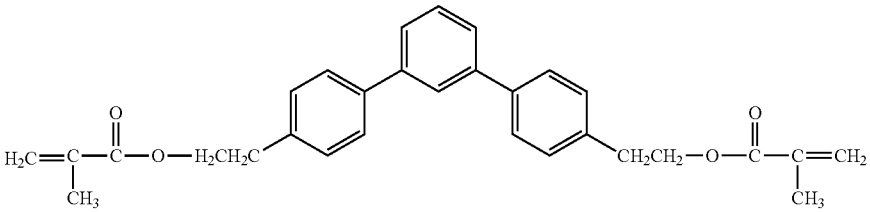
No. 8
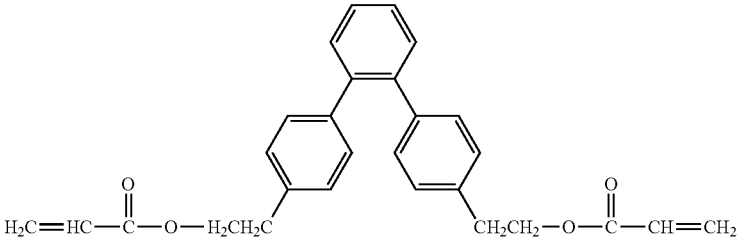

-continued
No. 9
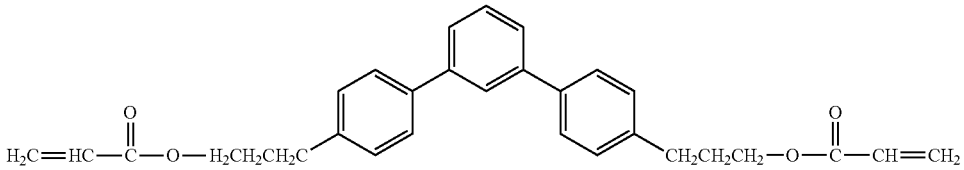
No. 10
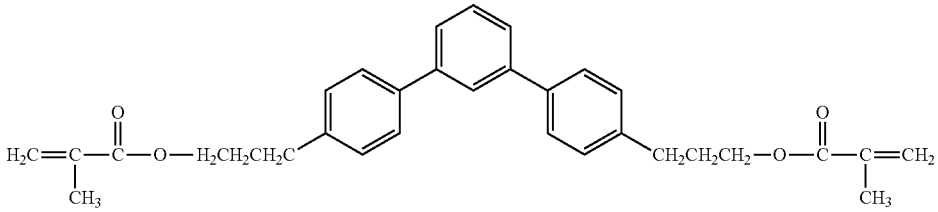
No. 11
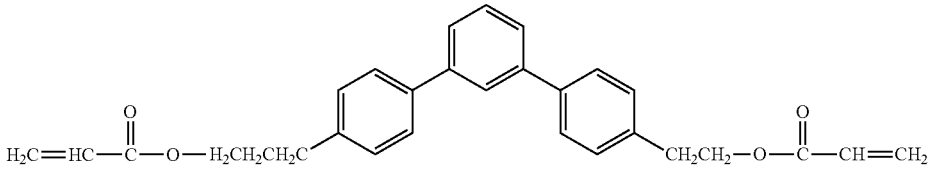
No. 12
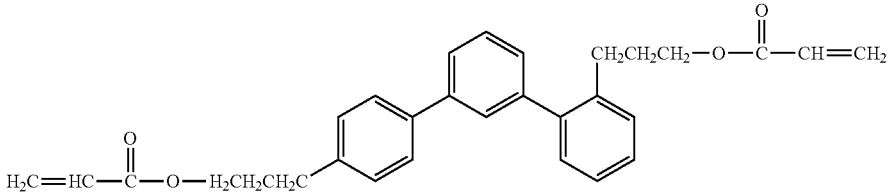
No. 13
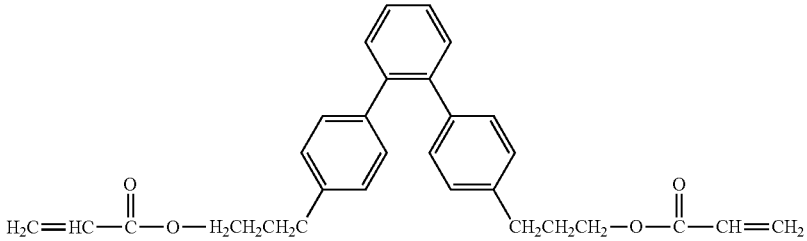
No. 14
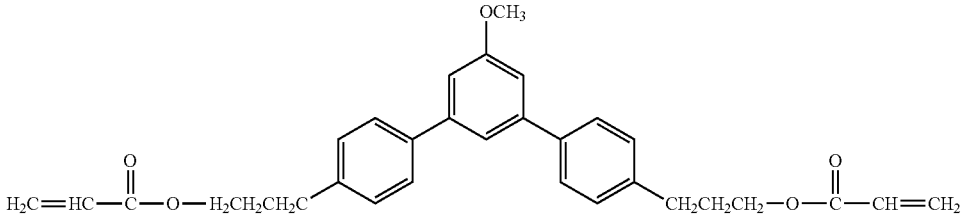
No. 15
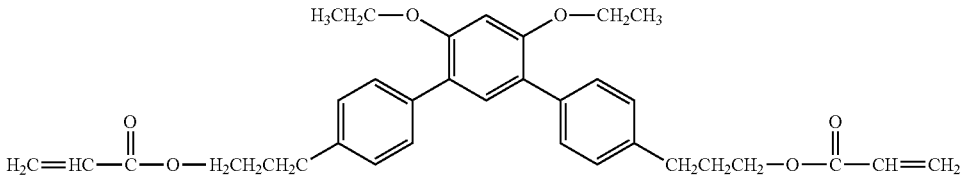

-continued
No. 16
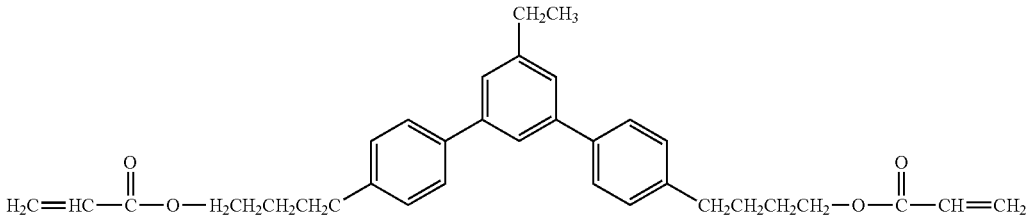
No. 17
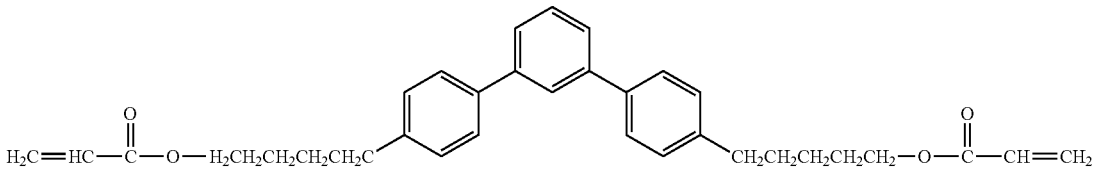
No. 18
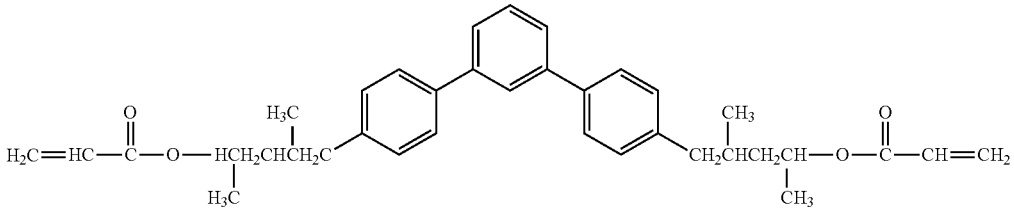
No. 19
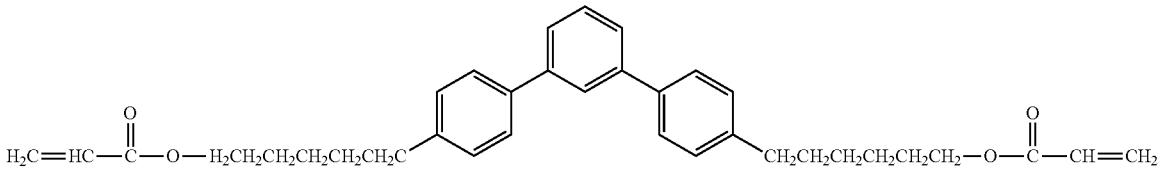
No. 20
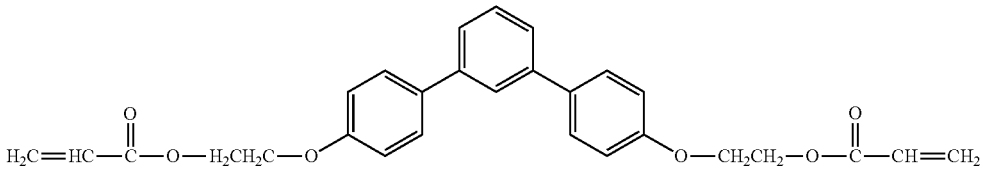
No. 21
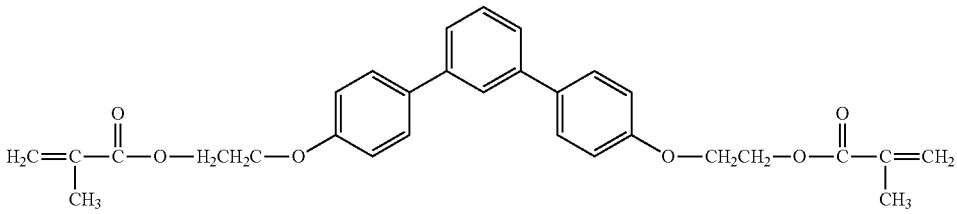
No. 22
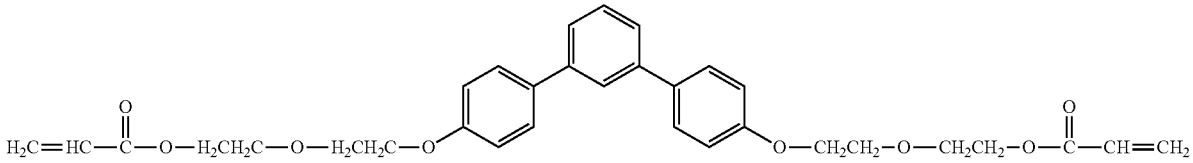

-continued
No. 23
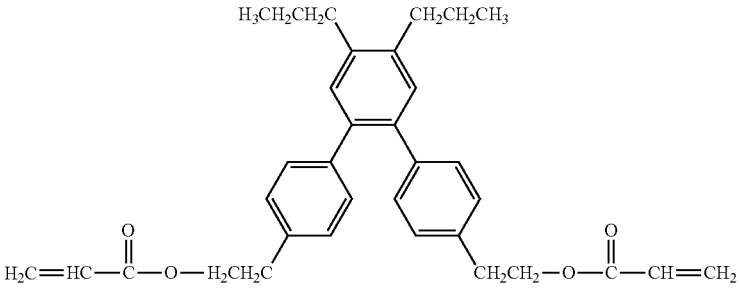
No. 24
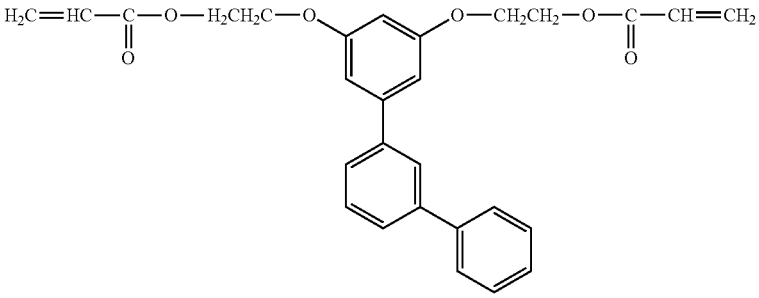
No. 25
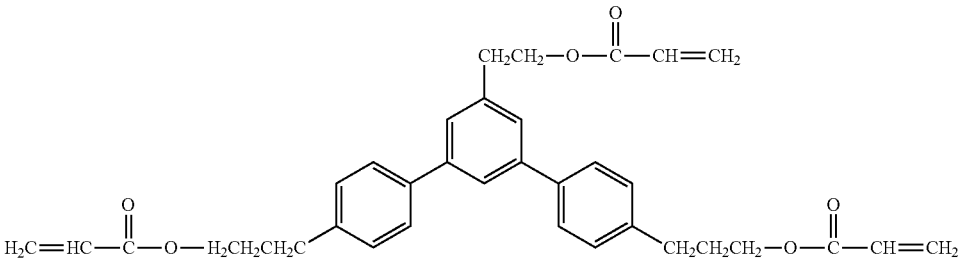
No. 26
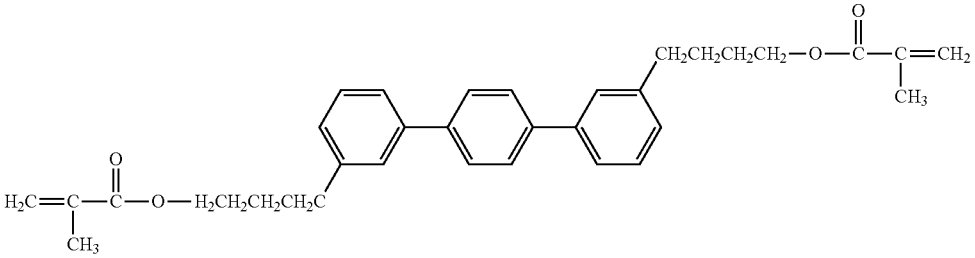
No. 27
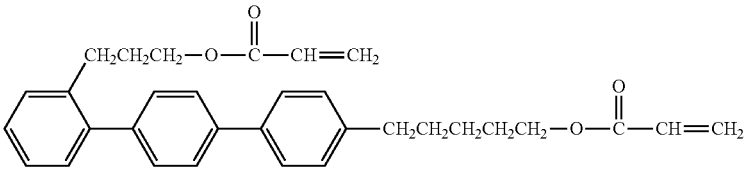
No. 28
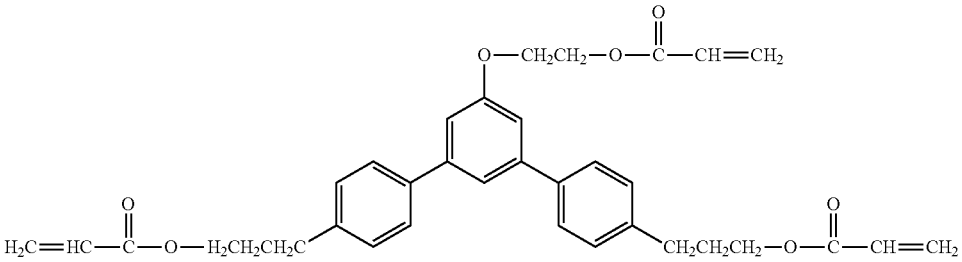

-continued
No. 29
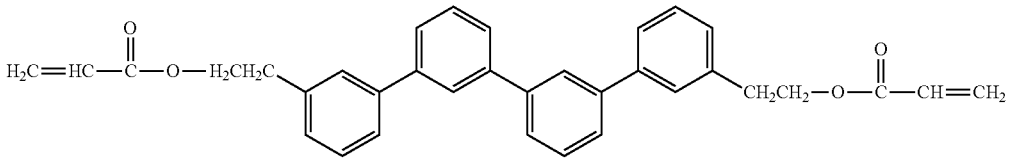
No. 30
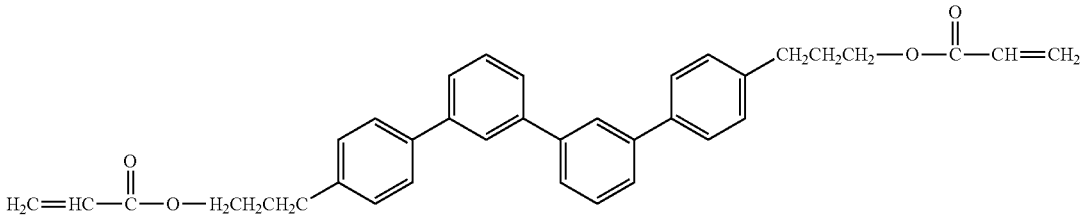
No. 31
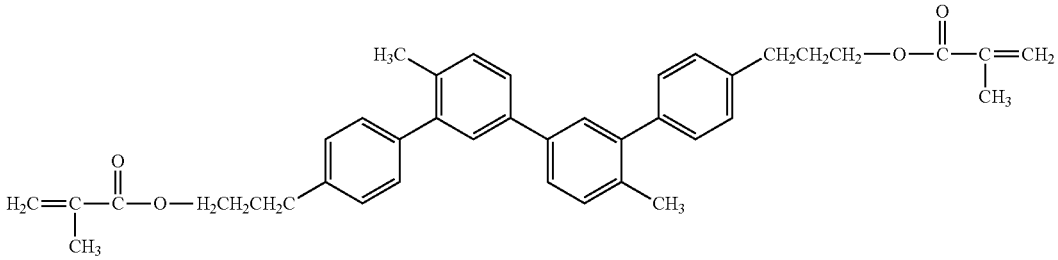
No. 32
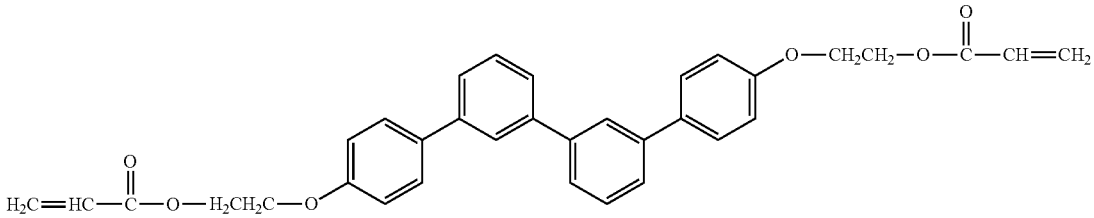
No. 33
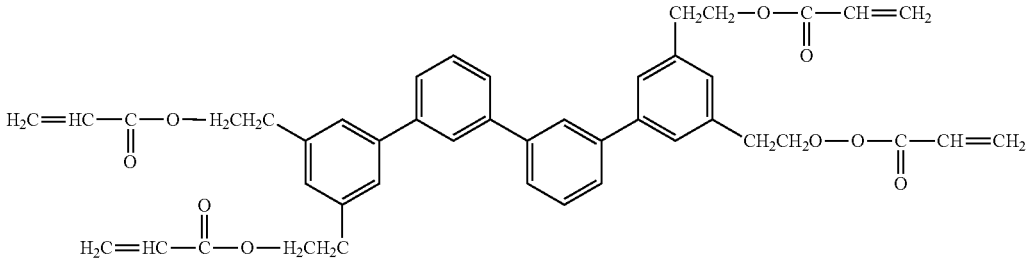
No. 34
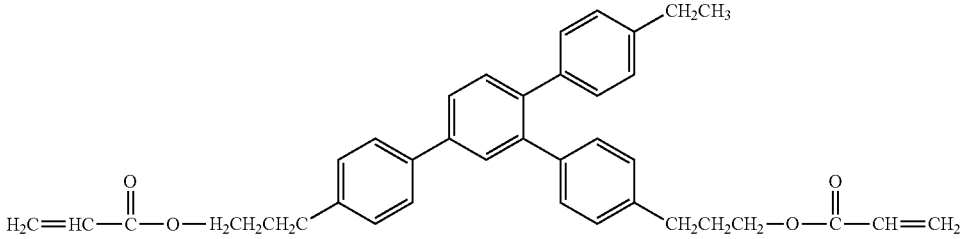

-continued
No. 35
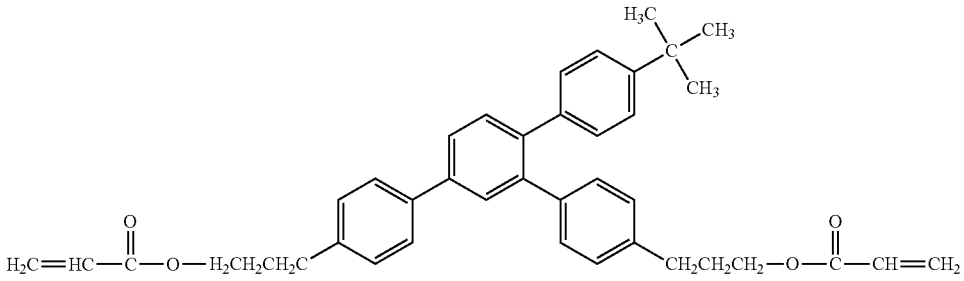
No. 36
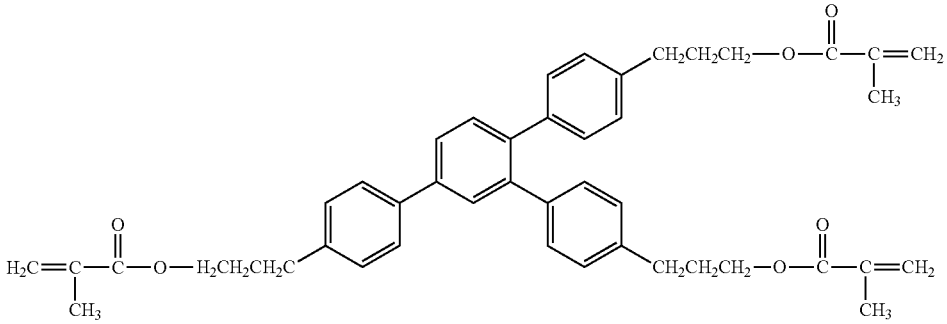
No. 37
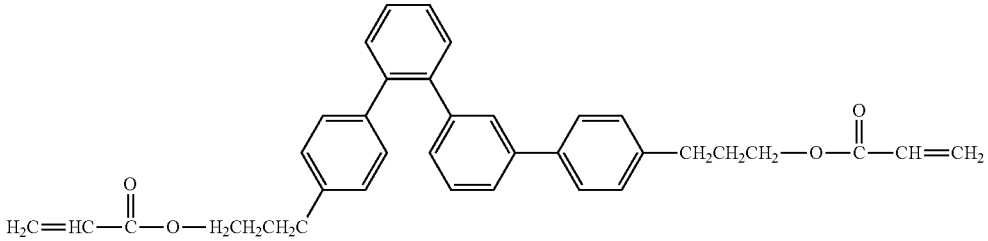
No. 38
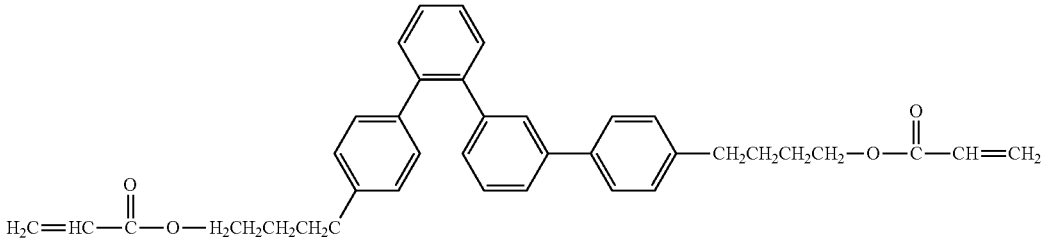
No. 39
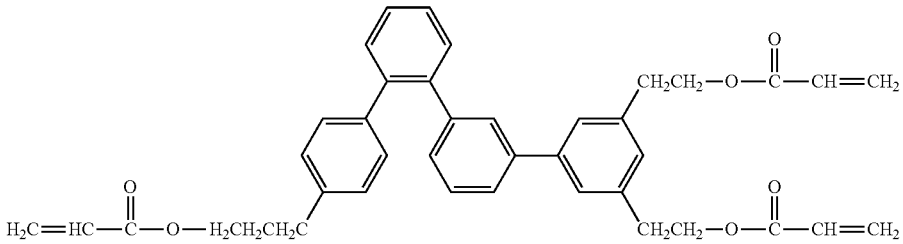
No. 40
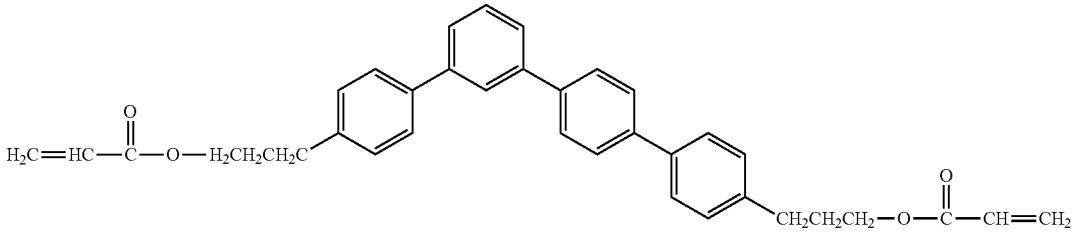

-continued
No. 41
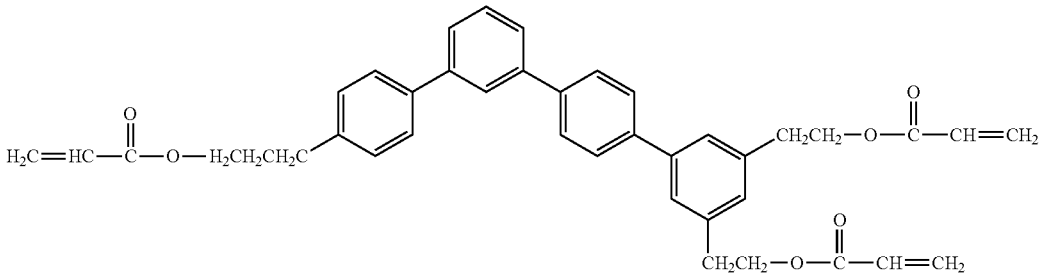
No. 42
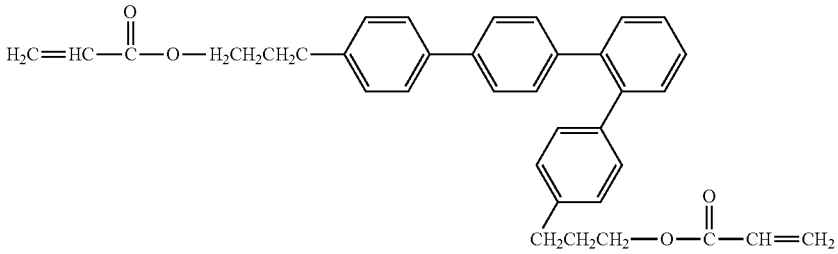
No. 43
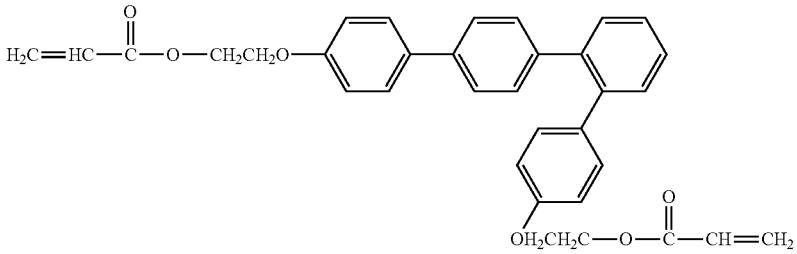
No. 44
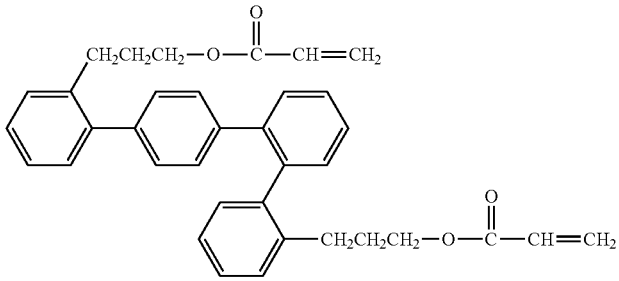
No. 45
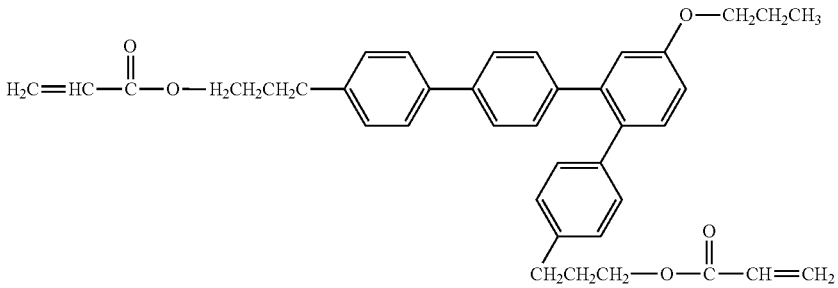

-continued
No. 46
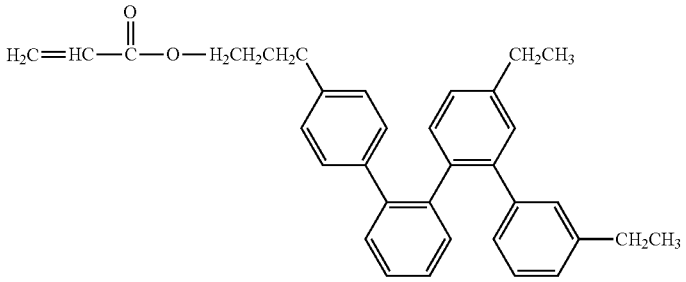
No. 47
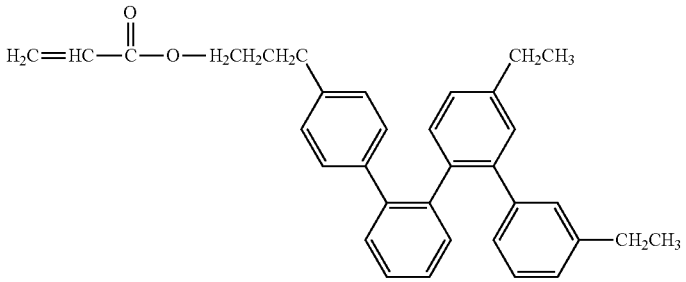
No. 48
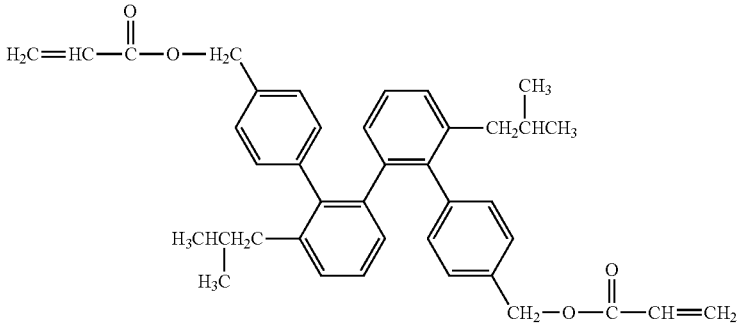
No. 49
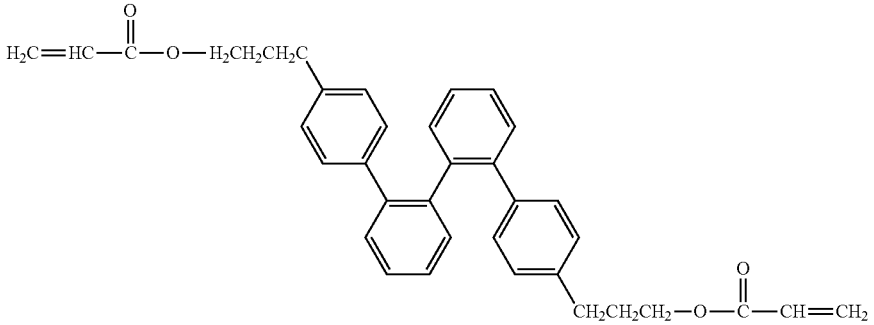
No. 50
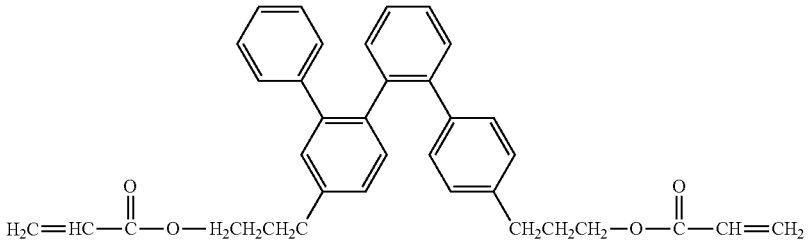

-continued
No. 51
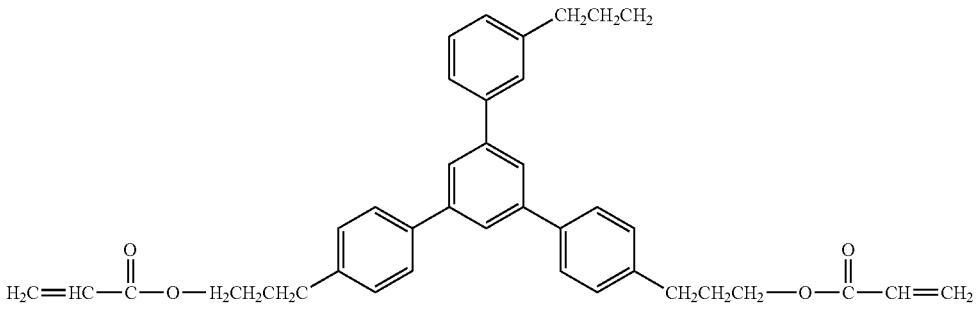
No. 52
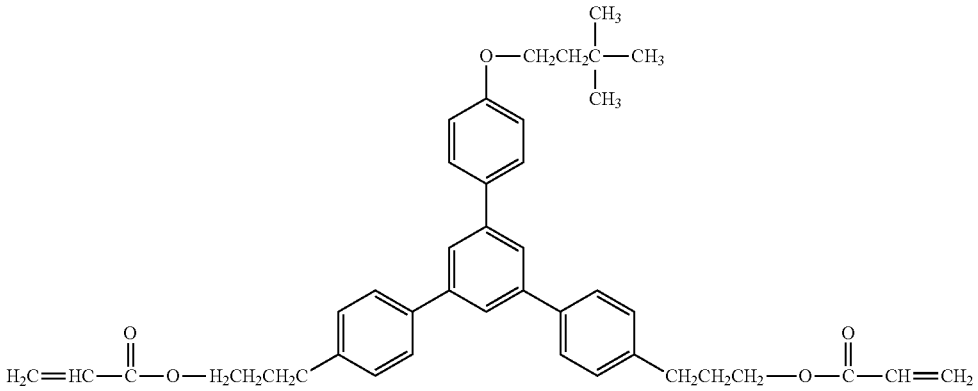
No. 53
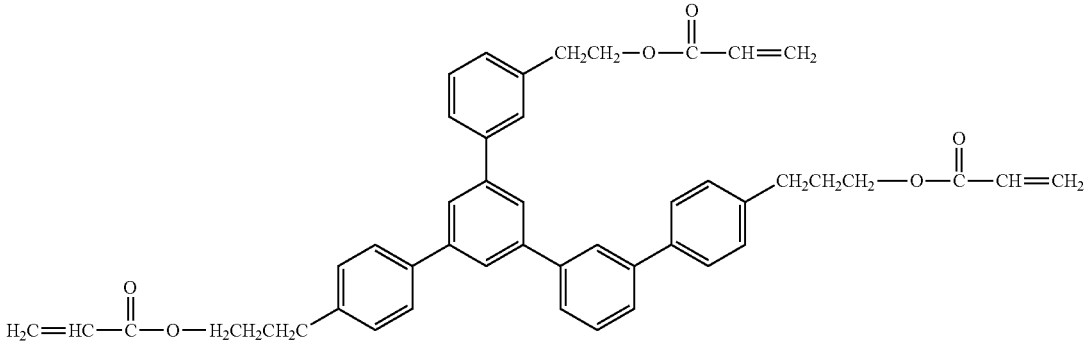
No. 54
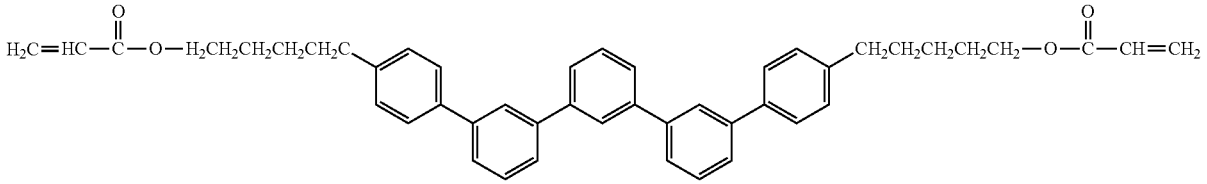
No. 55
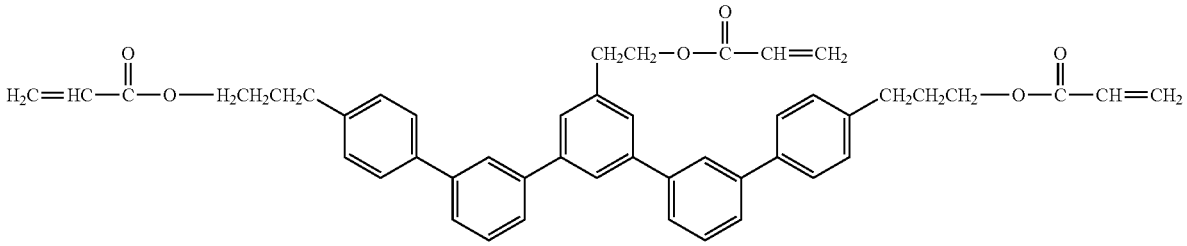

-continued
No. 56
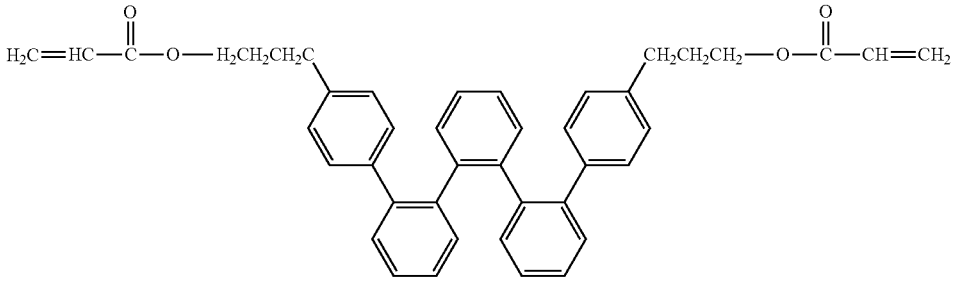
No. 57
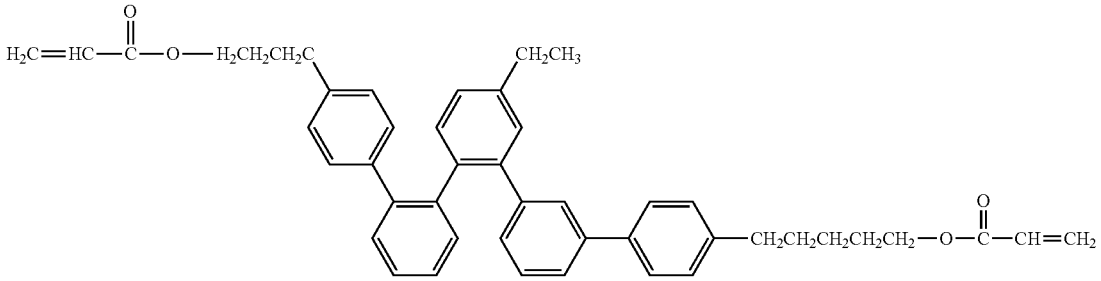
No. 58
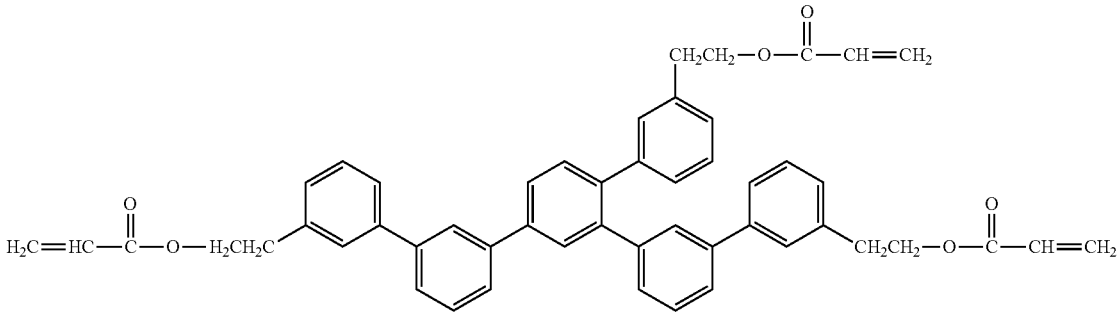
No. 59
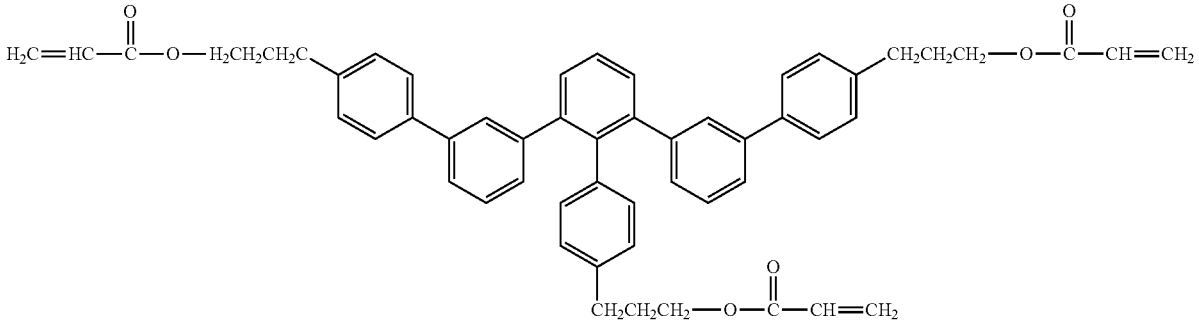
No. 60
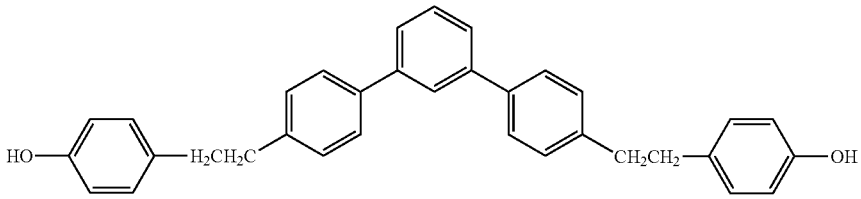

-continued

No. 61

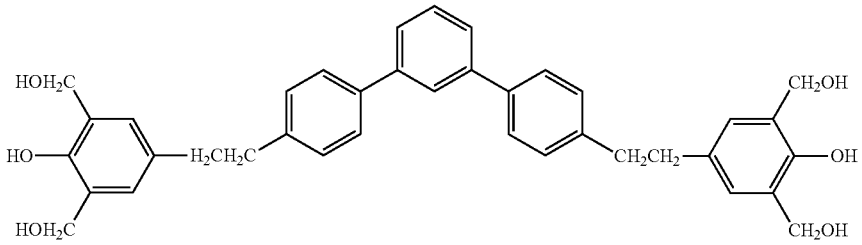

No. 62

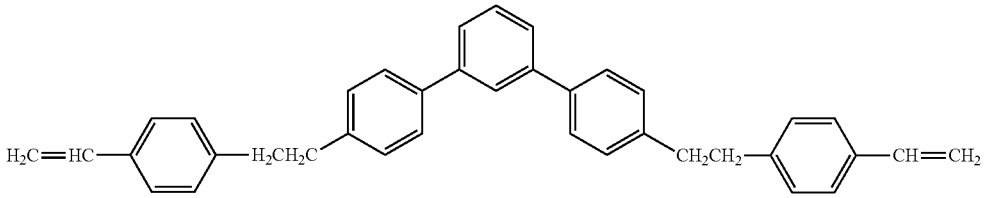

No. 63

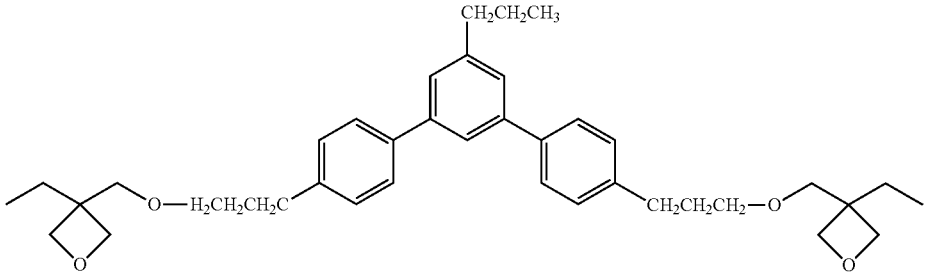

No. 64

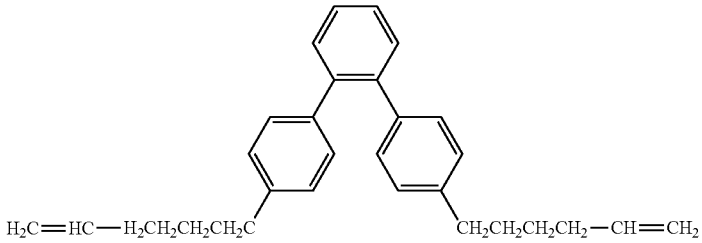

A representative synthesis example of the charge transporting substance for use in the present invention will be described below. The illustrative compound No. 9 is synthesized through the reaction represented by the following reaction formula (1).

Into a three-necked flask, 10 parts of a dihydroxy compound represented in reaction formula (1), 80 parts of tetrahydrofuran and 14.5 parts of triethylamine are put, and the resultant mixture is dissolved and then cooled with iced water. Subsequently, 7.84 parts of acryloyl chloride is slowly Reaction formula (1)

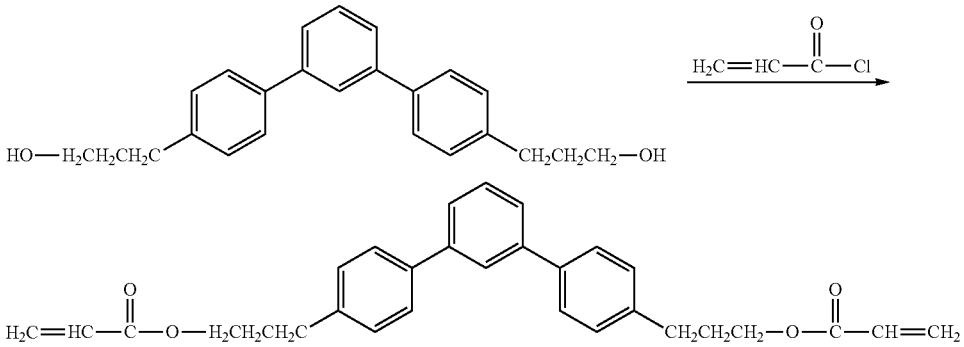

dropped into the mixture under cooling at 5° C. or lower taking care not to cause a temperature increase. After the completion of dropping, the reaction mixture is stirred for 1 hour while being cooled. Subsequently, the internal temperature of the reaction mixture is gradually raised until the internal temperature reaches room temperature and stirring is continued overnight.

After the completion of the reaction, 160 parts of a 5% sodium hydroxide aqueous solution is added to the reaction mixture. Into the resultant mixture, 180 parts of ethyl acetate is put and a product is extracted by separating the organic layer. Extraction operation is further conducted 3 times with 180 parts of ethyl acetate. The organic layer obtained is subjected to water washing operation around 3 times with pure water and a saline solution until the pH of the water layer becomes around 7. The organic layer obtained is dehydrated with anhydrous magnesium sulfate. Thereafter, the magnesium sulfate is removed through filtering and then the organic layer is concentrated to obtain a crude product.

The crude product obtained is subjected to silica gel column chromatography to remove impurities and collect a fraction containing the target product. The solvent is removed from the mixed solution obtained to purify a diacrylic group-introduced charge transporting substance that is the target compound. The yield of the illustrative compound No. 9 obtained is 6.8 parts or 51.9%.

As described above, an acrylate monomer is taken as an example and a reactive functional group-containing compound synthesized replacing, as necessary, the acryloyloxy group with a methacryloyloxy group or a reactive functional group other than the methacryloyloxy group may be used.

The surface layer may also contain various kinds of fine particles from the standpoint of wear resistance. The fine particle may be an inorganic fine particle or an organic fine particle. As the inorganic fine particle, a particle containing alumina, silica, zinc oxide, tin oxide, titanium oxide or the like is used.

As the organic fine particle, various kinds of organic resin fine particles can be used. Examples include polyolefin resins, polytetrafluoroethylene resins, polystyrene resins, polyacrylate resins, polymethacrylate resins, polyamide resins, polyester resins and polyurethane resins.

The surface layer can be formed by forming a coating film of a coating liquid for a surface layer, the coating liquid containing the polymerizable compound according to the present invention, and drying and/or curing the coating film.

As a solvent for use in the coating liquid for a surface layer, alcohol-based solvents, sulfoxide-based solvents, ketone-based solvents, ether-based solvents, ester-based solvents, halogenated aliphatic hydrocarbon-based solvents, aliphatic hydrocarbon-based solvents, aromatic hydrocarbon-based solvents and the like can be used.

The film thickness of the surface layer can be 0.1 μm or more and 15 μm or less in the case where the surface layer is a protective layer. The film thickness can be 5 μm or more and 40 μm or less in the case where the surface layer is a charge transporting layer.

Examples of the method for curing a coating film of a coating liquid for a surface layer (for polymerizing the surface layer according to the present invention) include a method for polymerizing the coating film using heat, light (such as ultraviolet ray) or a radiation (such as electron beam). Among these methods, a radiation is preferably used, and among radiations, an electron beam is more preferably used.

Polymerization can be conducted using an electron beam because a three-dimensional network structure is obtained and wear resistance is improved. Moreover, the polymerization reaction completes in a short time and effectively and therefore the productivity is also improved. In the case of irradiation with an electron beam, examples of the accelerator include a scanning type, an electrocurtain type, a broad beam type, a pulse type and a laminar type.

In the case where an electron beam is used, the acceleration voltage of the electron beam can be 150 kV or lower from the standpoint of enabling suppression of deterioration in material properties due to the electron beam without impairing polymerization efficiency. Moreover, the absorbed dose of the electron beam at the surface of the coating film of a coating liquid for a surface layer is preferably 5 kGy or higher and 50 kGy or lower, more preferably 1 kGy or higher and 10 kGy or lower.

In the case where the charge transporting substance according to the present invention is polymerized using an electron beam, the charge transporting substance can be heated in an inert gas atmosphere after the charge transporting substance is irradiated with the electron beam in an inert gas atmosphere for the purpose of suppressing polymerization-inhibiting action by oxygen. Examples of the inert gas include nitrogen, argon and helium.

Next, the overall configuration of the electrophotographic photosensitive member according to the present invention will be described.

<Electrophotographic Photosensitive Member>

A preferred configuration of the electrophotographic photosensitive member in the present invention is a configuration obtained by laminating a charge generating layer and a charge transporting layer on a support in this order. An electrically conductive layer or an undercoat layer may be provided between the charge generating layer and the support, and a protective layer may be provided on the charge transporting layer, as necessary. It is to be noted that the charge generating layer and the charge transporting layer altogether are referred to as a photosensitive layer in the present invention.

The charge transporting substance according to the present invention is contained in the surface layer. The surface layer in the present invention denotes a protective layer on the photosensitive layer in the case where the electrophotographic photosensitive member is provided with a protective layer or denotes a charge transporting layer in the case where the electrophotographic photosensitive member is not provided with a protective layer. Moreover, the photosensitive layer may be configured by a monolayer type photosensitive layer that contains a charge generating substance and a charge transporting substance.

<Support>

The support for use in the present invention can be a support having electrical conductivity (electrically conductive support). Examples of the material of the support include metals or alloys such as iron, copper, gold, silver, aluminum, zinc, titanium, lead, nickel, tin, antimony, indium, chromium, aluminum alloy and stainless steel. Moreover, a support made of a metal, the support having a film coat formed through vacuum deposition of aluminum, aluminum alloy, indium oxide-tin oxide alloy or the like or a support made of a resin can also be used. Moreover, a support obtained by impregnating a plastic or paper with an electrically conductive particle such as carbon black, a tin oxide particle, a titanium oxide particle or a silver particle and a support containing an electrically conductive resin can also be used. Examples of the shape of the support include a cylindrical shape, a belt shape, a sheet shape or a plate shape, and the cylindrical shape is the most common.

The surface of the support may be subjected to cutting treatment, roughening treatment, alumite treatment or the like from the standpoint of suppressing interference fringes due to laser light scattering, improving surface defects of the support, improving the electrical conductivity of the support or other purposes.

An electrically conductive layer may be provided between the support and the undercoat layer or charge generating layer, which will be described later, for the purpose of suppressing interference fringes due to scattering of laser or the like, controlling the resistance or coating the scratches on the support.

The electrically conductive layer can be formed by coating the support with a coating liquid for an electrically conductive layer, the coating liquid obtained by subjecting carbon black, an electrically conductive pigment, a resistance-adjusting pigment or the like to dispersion treatment together with a binder resin, and drying a coating film obtained. A compound that is cured and polymerized by heating, ultraviolet ray irradiation, radiation irradiation or the like may be added to the coating liquid for an electrically conductive layer. There is a tendency that the surface of the electrically conductive layer containing an electrically conductive pigment or a resistance-adjusting pigment dispersed therein is roughened.

The film thickness of the electrically conductive layer is preferably 0.1 μm or more and 50 μm or less, more preferably 0.5 μm or more and 40 μm or less, and still more preferably 1 μm or more and 30 μm or less.

Examples of the binder resin for use in the electrically conductive layer include polymers and copolymers of vinyl compounds such as styrene, vinyl acetate, vinyl chloride, acrylates, methacrylates, vinylidene fluoride and trifluoroethylene, polyvinyl alcohol resins, polyvinyl acetal resins, polycarbonate resins, polyester resins, polysulfone resins, polyphenylene oxide resins, polyurethane resins, cellulose resins, phenol resins, melamine resins, silicon resins, epoxy resins and isocyanate resins.

Examples of the electrically conductive pigment and the resistance-adjusting pigment include a particle of a metal (alloy) such as aluminum, zinc, copper, chromium, nickel, silver or stainless steel and a particle obtained through vacuum deposition of one of these metals (alloys) on the surface of a plastic. Moreover, a particle of a metal oxide such as zinc oxide, titanium oxide, tin oxide, antimony oxide, indium oxide, bismuth oxide, tin-doped indium oxide, antimony- or tantalum-doped tin oxide may be used. These particles may be used singly or in a combination of two or more.

An undercoat layer (intermediate layer) may be provided between the support or electrically conductive layer and the charge generating layer for the purpose of improving adhesiveness of the charge generating layer, improving positive hole injection properties from the support, protecting the charge generating layer against an electrical breakdown, or other purposes.

The undercoat layer can be formed by drying a coating film obtained through coating with a coating liquid for an undercoat layer, the coating liquid obtained by dissolving a binder resin in a solvent.

Examples of the binder resin for use in the undercoat layer include polyvinyl alcohol resins, poly-N-vinylimidazole, polyethylene oxide resins, ethyl cellulose, ethylene-acrylic acid copolymers, casein, polyamide resins, N-methoxymethylated 6-nylon resins, copolymer nylon resins, phenol resins, polyurethane resins, epoxy resins, acrylic resins, melamine resins or polyester resins.

The undercoat layer may further contain a metal oxide particle. Examples of the metal oxide particle include a particle that contains titanium oxide, zinc oxide, tin oxide, zirconium oxide or aluminum oxide. Moreover, the metal oxide particle may be a metal oxide particle the surface of which is treated with a surface treating agent such as a silane coupling agent.

The film thickness of the undercoat layer is preferably 0.05 μm or more and 30 μm or less, more preferably 1 μm or more and 25 μm or less. The undercoat layer may further contain an organic resin fine particle or a levelling agent.

Next, the charge generating layer will be described. The charge generating layer can be formed by forming a coating film through coating with a coating liquid for a charge generating layer, the coating liquid obtained by subjecting a charge generating substance to dispersion treatment together with a binder resin and a solvent, and drying the coating film obtained. Moreover, the charge generating layer may be a vapor deposited film of a charge generating substance.

Examples of the charge generating substance for use in the charge generating layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, anthanthrone pigments, pyranthrone pigments, xanthene dyes, quinoneimine dyes and styryl dyes. These charge generating substances may be used singly or of two or more of these charge generating substances may be used. Among these charge generating substances, phthalocyanine pigments and azo pigments are preferably used from the standpoint of sensitivity and particularly, phthalocyanine pigments are more preferably used.

Among the phthalocyanine pigments, particularly, oxytitanium phthalocyanine, chloro gallium phthalocyanine and hydroxy gallium phthalocyanine exhibit an excellent charge generating efficiency. Furthermore, among hydroxy gallium phthalocyanines, hydroxy gallium phthalocyanine crystals of a crystal form having peaks at a Bragg angle $2\theta$ of $7.4°\pm0.3°$ and of $28.2°\pm0.30$ in CuKα characteristic X-ray diffraction are more preferably used from the standpoint of sensitivity.

Examples of the binder resin for use in the charge generating layer include polymers of vinyl compounds such as styrene, vinyl acetate, vinyl chloride, acrylates, methacrylates, vinylidene fluoride and trifluoroethylene, polyvinyl alcohol resins, polyvinyl acetal resins, polycarbonate resins, polyester resins, polysulfone resins, polyphenylene oxide resins, polyurethane resins, cellulose resins, phenol resins, melamine resins, silicon resins and epoxy resins.

The mass ratio of the charge generating substance and the binder resin can be in a range of 1:0.3 to 1:4.

The film thickness of the charge generating layer is preferably 0.05 μm or more and 1 μm or less, more preferably 0.1 μm or more and 0.5 μm or less.

Next, the charge transporting layer will be described. In the case where the charge transporting layer is the surface layer, the charge transporting layer contains a copolymer of the charge transporting substance according to the present invention and the compound represented by the formula (1) as described above.

On the other hand, in the case where a protective layer is provided on the charge transporting layer, the charge transporting layer can be formed by forming a coating film of a coating liquid for a charge transporting layer, the coating liquid obtained by mixing a charge transporting substance and a binder resin in a solvent, and drying the coating film.

The charge transporting substance and the resin binder for use in the charge transporting layer will be described below.

Examples of the charge transporting substance include carbazole compounds, hydrazone compounds, N,N-dialkylaniline compounds, diphenylamine compounds, triphenylamine compounds, triphenylmethane compounds, pyrazoline compounds, styryl compounds and stilbene compounds.

Examples of the binder resin for use in the charge transporting layer include acrylates, methacrylates, polyvinyl alcohol resins, polyvinyl acetal resins, polycarbonate resins and polyester resins. Curable resins such as curable phenol resins, curable urethane resins, curable melamine resins, curable epoxy resins, curable acrylic resins and curable methacrylic resins can also be used.

Examples of the solvent for use in the coating liquid for a charge transporting layer include alcohol-based solvents, sulfoxide-based solvents, ketone-based solvents, ether-based solvents, ester-based solvents, halogenated aliphatic hydrocarbon-based solvents and aromatic hydrocarbon-based solvents.

The film thickness of the charge transporting layer is preferably 1 μm or more and 100 μm or less, more preferably 3 μm or more and 50 μm or less, and still more preferably 5 μm or more and 40 μm or less.

Various kinds of additives can be added to each layer of the electrophotographic photosensitive member according to the present invention. Specific examples include organic pigments, organic dyes, surface conditioners for a coating film, electron transporting agents, oils, waxes, antioxidants, light absorbers, polymerization initiators, radical deactivators, organic resin fine particles and inorganic particles.

Surface finishing may be applied to the surface of each layer of the electrophotographic photosensitive member using a polishing sheet, a mold member for shape transfer, a glass bead, a zirconia bead or the like. Moreover, unevenness may be formed on the surface using a constituent material of a coating liquid.

When coating is conducted with the coating liquid for each layer, any of publicly known coating methods such as, for example, a dip coating method, a spray coating method, a circular amount-controlling type (ring) coating method, a spin coating method, a roller coating method, a Meyer bar coating method and a blade coating method can be used.

Next, a process cartridge provided with an electrophotographic photosensitive member according to the present invention and a process for forming an image will be described.

An example of a configuration of a process cartridge according to the present invention is illustrated in FIG. 1. In FIG. 1, an electrophotographic photosensitive member 1 in a cylindrical shape is rotationally driven in an arrow direction with a predetermined peripheral velocity. The circumferential face of the rotationally driven electrophotographic photosensitive member 1 is uniformly charged to a predetermined positive or negative potential with a charging unit 2. Subsequently, the circumferential face of the charged electrophotographic photosensitive member 1 receives exposing light (image-exposing light) 3 output from an exposing unit (not illustrated in figure), such as slit exposure or exposure by laser beam scanning. In this way, an electrostatic latent image corresponding to the target image is formed sequentially on the circumferential face of the electrophotographic photosensitive member 1. As the voltage to be applied to the charging unit (such as charging roller) 2, any of voltage obtained by superposing an alternating-current component on a direct-current component and voltage composed of only a direct-current component may be used.

The electrostatic latent image formed on the circumferential face of the electrophotographic photosensitive member 1 is developed by a toner contained in a developing agent in a developing unit 4 to become a toner image. Subsequently, the toner image formed and carried on the circumferential face of the electrophotographic photosensitive member 1 is transferred to a transfer material (such as paper or intermediate transfer body) 6 sequentially by transfer bias from a transfer unit (such as transfer roller) 5. The transfer material 6 is fed synchronously with the rotation of the electrophotographic photosensitive member 1.

The surface of the electrophotographic photosensitive member 1 after the toner image is transferred is subjected to treatment for removal of electricity by pre-exposing light 7 from a pre-exposing unit (not illustrated in figure) and thereafter is made clean by undergoing removal of toner left after transfer with a cleaning unit 8, so that the electrophotographic photosensitive member 1 is used for image formation repeatedly. It is to be noted that the pre-exposing unit may be prior to or after the cleaning process, but the pre-exposing unit is not absolutely necessary.

The electrophotographic photosensitive member 1 may be installed in an electrophotographic apparatus such as a copying machine or a laser beam printer. Moreover, a process cartridge 9 configured by accommodating a plurality of constituents among the constituents such as the electrophotographic photosensitive member 1, the charging unit 2, the developing unit 4 and the cleaning unit 8 in a container and integrally supporting the constituents is made to be detachably attachable to an electrophotographic apparatus main body to configure the electrophotographic apparatus main body. In FIG. 1, the electrophotographic photosensitive member 1, the charging unit 2, the developing unit 4 and the charging unit 8 are integrally supported to make the process cartridge 9 that is detachably attachable to the electrophotographic apparatus main body.

Next, an electrophotographic apparatus provided with an electrophotographic photosensitive member according to the present invention will be described.

Figure 2:
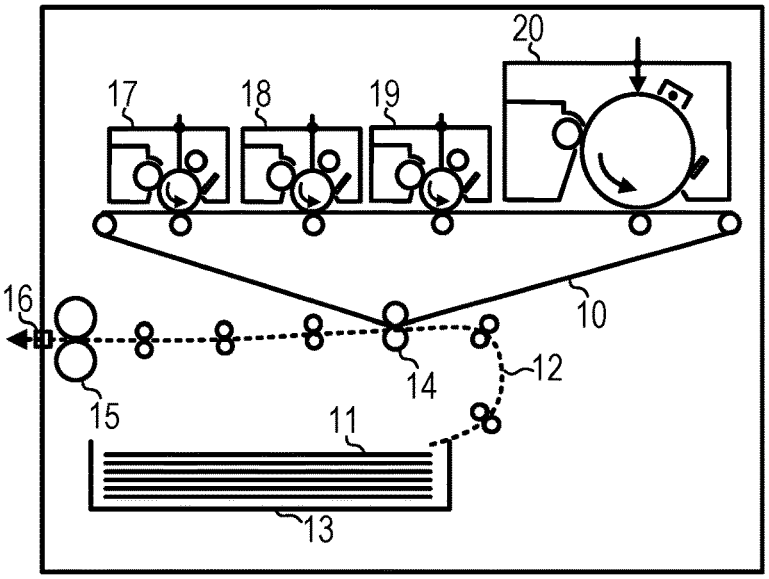
FIG. 2 is a schematic diagram illustrating an example of an electrophotographic apparatus including an electrophotographic photosensitive member.

An example of a configuration of the electrophotographic apparatus according to the present invention is illustrated in FIG. 2. A process cartridge 17 for yellow, a process cartridge 18 for magenta, a process cartridge 19 for cyan and process cartridge 20 for black each corresponding to yellow, magenta, cyan and black respectively are placed in a row along an intermediate transfer body 10. As illustrated in FIG. 2, the diameters and constituents of electrophotographic photosensitive members, the developing agents, the charging systems and other units are not necessarily unified among respective colors. For example, in the electrophotographic apparatus in FIG. 2, the diameter of the electrophotographic photosensitive member for black is larger than the diameters of the electrophotographic photosensitive members for colors (yellow, magenta, cyan). Moreover, as the charging system for colors, a system in which voltage obtained by superposing an alternating-current component on a direct-current component is applied is adopted. Meanwhile, a system using corona discharge is adopted for black.

When the image forming operation is started, toner images for respective colors are superposed sequentially on the intermediate transfer body 10 following the image forming process described above. In parallel, transfer paper 11 is sent out from a paper feeding tray 13 by a paper feeding path 12 and fed to a secondary transfer unit 14 with the timing of the feed matched with the rotating operation of the intermediate transfer body. The toner images on the intermediate transfer body 10 are transferred to the transfer paper 11 by the transfer bias from the secondary transfer unit 14. The toner images transferred on the transfer paper 11 are conveyed along the paper feeding path 12 and fixed on the transfer paper with a fixing unit 15, and the transfer paper is discharged from a paper discharge section 16. It is to be noted that a roller not labeled by a sign in the paper feeding path of the transfer paper in FIG. 2 denotes a conveying roller or a resist roller.

EXAMPLES

Hereinafter, the present invention will be described in more detail giving specific examples. It is to be noted that "parts" in Examples mean "parts by mass". In addition, the electrophotographic photosensitive member is also simply referred to as "photosensitive member"

Preparation of Electrophotographic Photosensitive Member

Example 1

A cylindrical shape aluminum cylinder having an outer diameter of 84.0 mm, a length of 370.0 mm and a wall thickness of 3.0 mm was used as a support (conductive support).

Subsequently, 10 parts of a zinc oxide particle (specific surface area: 19 $m^2/g$, powder resistivity: $4.7\times10^6$ Ω·cm) was stirred and mixed with 50 parts of toluene, 0.08 parts of a silane coupling agent was then added thereto and the resultant mixture was stirred for 6 hours. Thereafter, toluene was distilled away under reduced pressure and the residue was dried by heating at 130° C. for 6 hours to obtain a surface-treated zinc oxide particle. As the silane coupling agent, KBM602 (compound name: N-2-(aminoethyl)-3-aminopropyl methyl dimethoxy silane) manufactured by Shin-Etsu Chemical Co., Ltd. was used.

Subsequently, 15 parts of a polyvinyl butyral resin (weight average molecular weight: 40000, trade name: BM-1, manufactured by Sekisui Chemical Co., Ltd.) and 15 parts of blocked isocyanate (trade name: Duranate TPA-B80E, manufactured by Asahi Kasei Chemicals Corporation) were dissolved in a mixed solution of 73.5 parts of methyl ethyl ketone and 73.5 parts of 1-butanol. To the solution, 80.8 parts of the surface-treated zinc oxide particle and 0.8 parts of 2,3,4-trihydroxy benzophenone (manufactured by Wako Pure Chemical Industries, Ltd.) were added and the resultant mixture was dispersed with a sand mill apparatus with a glass bead having a diameter of 0.8 mm under an atmosphere of 23±3° C. for 3 hours. After the dispersion, 0.01 parts of a silicone oil (trade name: SH 28 PA, manufactured by Dow Corning Toray Co., Ltd.) and 5.6 parts of a crosslinked polymethylmethacrylate (PMMA) particle (trade name: TECHPOLYMER SSX-102, manufactured by Sekisui Plastics Co., Ltd., average primary particle diameter of 2.5 μm) were added to the dispersion liquid and the resultant mixture was stirred to prepare a coating liquid for an undercoat layer.

The support was dip-coated with the coating liquid for an undercoat layer to form a coating film and the coating film obtained was dried at 160° C. for 40 minutes to form an undercoat layer having a film thickness of 18 μm.

Subsequently, a hydroxy gallium phthalocyanine crystal (charge generating substance) of a crystal form having peaks at a Bragg angle 2θ±0.2° of 7.4° and of 28.2° in CuKα characteristic X-ray diffraction was prepared. In a sand mill with a glass bead having a diameter of 1 mm, 2 parts of the hydroxy gallium phthalocyanine crystal, 0.02 parts of a calixarene compound represented by the following structural formula (A), 1 part of polyvinyl butyral (trade name: S-LEC BX-1, manufactured by Sekisui Chemical Co., Ltd.) and 60 parts of cyclohexanone were placed and were subjected to dispersion treatment for 4 hours. Thereafter, 70 parts of ethyl acetate was added thereto to prepare a coating liquid for a charge generating layer. The undercoat layer was dip-coated with the coating liquid for a charge generating layer and a coating film obtained was dried at 90° C. for 15 minutes to form a charge generating layer having a film thickness of 0.19 μm.

(A)

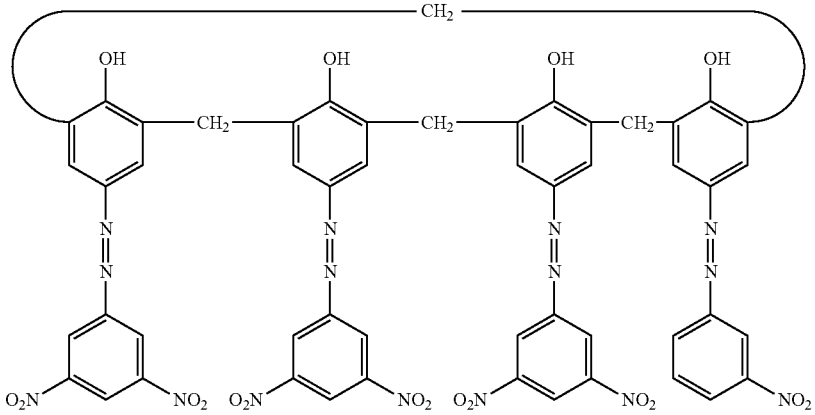

Subsequently, 6 parts of the compound represented by the following structural formula (B), 3 parts of the compound represented by the following structural formula (C), 1 part of the compound represented by the following structural formula (D) and 10 parts of a bisphenol Z type polycarbonate resin (trade name: Iupilon Z400, manufactured by Mitsubishi Engineering-Plastics Corporation) were dissolved in a mixed solvent of 60 parts of monochlorobenzene/20 parts of dimethoxymethane to prepare a coating liquid for a charge transporting layer. The charge generating layer was dip-coated with the coating liquid for a charge transporting layer and a coating film obtained was dried at 100° C. for 50 minutes to form a charge transporting layer having a film thickness of 21 μm.

(B)

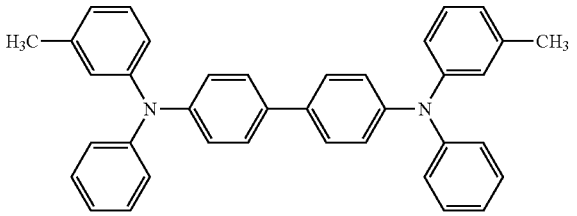

(C)

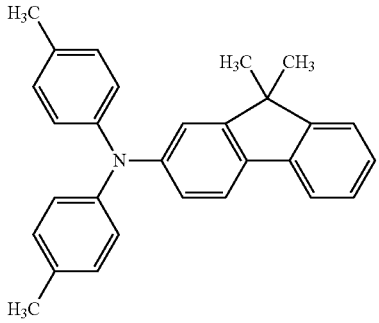

(D)

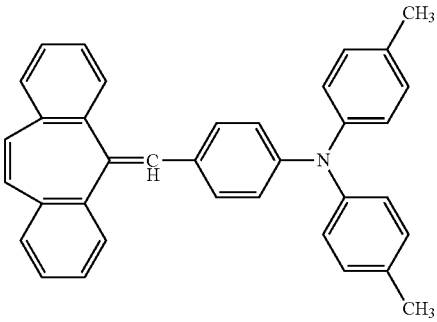

Subsequently, 3.6 parts of a polymerizable functional group-containing charge transporting substance represented by the following formula (E) and 2.4 parts of the compound represented by the illustrative compound No. 9 were dissolved in 7 parts of 1-propanol and 7 parts of ZEORORA H (manufactured by Zeon Corporation) as solvents to prepare a coating liquid for a protective layer. The charge transporting layer was dip-coated with the coating liquid for a protective layer and a coating film obtained was dried at 50° C. for 10 minutes and was subjected to electron beam irradiation and polymerization/curing treatment by heating under the following conditions.

(E)

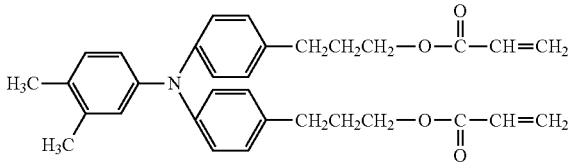

In an atmosphere of an oxygen concentration of 100 ppm or lower, the electron beam irradiation was conducted using an electron beam irradiation apparatus under conditions of an irradiation distance of 30 mm, an acceleration voltage of 150 kV, a beam current of 5.0 mA and an irradiation time of 6.4 seconds while the aluminum cylinder was rotated at a speed of 100 rpm. After the electron beam irradiation, the temperature on the surface of the coating film of the protective layer was raised to 130° C. in 90 seconds using an induction heating apparatus. Subsequently, the aluminum cylinder was taken out into an air atmosphere and further heated at 100° C. for 10 minutes to form a protective layer having a film thickness of 4.5 μm. An example photosensitive member 1 was prepared in the manner as described above.

Example 2

A protective layer was formed in the manner as described below. The amount of the charge transporting substance represented by the formula (E) was changed to 4.2 parts and the amount of the compound represented by the illustrative compound No. 9 was changed to 1.8 parts. An electrophotographic photosensitive member (example photosensitive member 2) was produced in the same manner as in the production of the example photosensitive member 1 excluding the above changes.

Example 3

A protective layer was formed in the manner as described below. The amount of the charge transporting substance represented by the formula (E) was changed to 4.8 parts and the amount of the compound represented by the illustrative compound No. 9 was changed to 1.2 parts. An electrophotographic photosensitive member (example photosensitive member 3) was produced in the same manner as in the production of the example photosensitive member 1 excluding the above changes.

Example 4

A protective layer was formed in the manner as described below. The amount of the charge transporting substance represented by the formula (E) was changed to 4.2 parts and the amount of the compound represented by the illustrative compound No. 13 was changed to 1.8 parts. An electrophotographic photosensitive member (example photosensitive member 4) was produced in the same manner as in the production of the example photosensitive member 1 excluding the above changes.

Example 5

A protective layer was formed in the manner as described below. The amount of the charge transporting substance represented by the formula (E) was changed to 4.2 parts and the amount of the compound represented by the illustrative compound No. 49 was changed to 1.8 parts. An electrophotographic photosensitive member (example photosensitive member 5) was produced in the same manner as in the production of the example photosensitive member 1 excluding the above changes.

Example 6

Production was conducted to the formation of a charge transporting layer in the same manner as in Example 1.

Subsequently, 3.6 parts of a polymerizable functional group-containing charge transporting substance represented by the following formula (F) and 2.4 parts of the compound represented by the illustrative compound No. 10 were dissolved in 7 parts of 1-propanol and 7 parts of ZEORORA H (manufactured by Zeon Corporation) as solvents to prepare a coating liquid for a protective layer. The charge transporting layer was dip-coated with the coating liquid for a protective layer and a coating film obtained was dried at 50° C. for 10 minutes and was subjected to electron beam irradiation and polymerization/curing treatment by heating under the following conditions. An electrophotographic photosensitive member (example photosensitive member 6) was produced in the manner as described above.

(F)

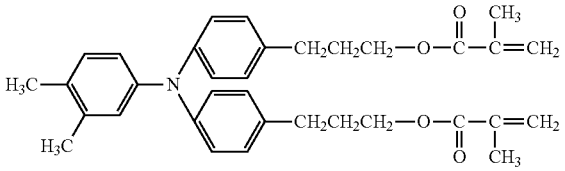

Example 7

A protective layer was formed in the manner as described below. The amount of the charge transporting substance represented by the formula (F) was changed to 4.8 parts and the amount of the compound represented by the illustrative compound No. 21 was changed to 1.2 parts. An electrophotographic photosensitive member (example photosensitive member 7) was produced in the same manner as in the production of the example photosensitive member 1 excluding the above changes.

Example 8

A protective layer was formed in the manner as described below. The amount of the charge transporting substance represented by the formula (E) was changed to 4.2 parts and the compound and the amount thereof were changed to 1.8 parts of the compound represented by the illustrative compound No. 25. An electrophotographic photosensitive member (example photosensitive member 8) was produced in the same manner as in the production of the example photosensitive member 1 excluding the above changes.

Example 9

A protective layer was formed in the manner as described below. The amount of the charge transporting substance represented by the formula (E) was changed to 4.2 parts and the compound and the amount thereof were changed to 1.8 parts of the compound represented by the illustrative compound No. 43. An electrophotographic photosensitive member (example photosensitive member 9) was produced in the same manner as in the production of the example photosensitive member 1 excluding the above changes.

Example 10

An electrophotographic photosensitive member 10 was produced in the same manner as in the production of the example photosensitive member 1 except that a protective layer was formed in the manner as described below.

In a mixed solvent of 45 parts of 1-propanol and 45 parts of ZEORORA H, 1.5 parts of a fluorine atom-containing resin (trade name: GF-400, manufactured by Toagosei Co., Ltd.) was dissolved. Thereafter, 30 parts of an ethylene fluoride resin powder (trade name: Lubron L-2, manufactured by Daikin Industries, Ltd.) was added to the solution and the resultant mixture was dispersed with a high-pressure disperser (trade name: Microfluidizer M-110EH, manufactured by Microfluidics Corp.) to obtain an ethylene fluoride resin dispersion liquid.

A coating liquid for a protective layer was prepared by stirring and uniformly dispersing 2.4 parts of the charge transporting substance represented by the formula (E), 1.6 parts of the compound represented by the illustrative compound No. 9, 8 parts of the ethylene fluoride resin dispersion liquid, 3 parts of 1-propanol and 3 parts of ZEORORA H. The charge transporting layer was dip-coated to form a protective layer in the same manner as in Example 1. An example photosensitive member 10 was prepared in the manner as described above.

Example 11

An electrophotographic photosensitive member was produced in the same manner as in the production of the example photosensitive member 1 except that a protective layer was formed in the manner as described below.

A coating liquid for a protective layer was prepared by stirring and uniformly dispersing 2.8 parts of the charge transporting substance represented by the formula (E), 1.2 parts of the compound represented by the illustrative compound No. 9, 8 parts of the ethylene fluoride resin dispersion liquid, 3 parts of 1-propanol and 3 parts of ZEORORA H. The charge transporting layer was dip-coated to form a protective layer in the same manner as in Example 1. An example photosensitive member 11 was prepared in the manner as described above.

Example 12

An electrophotographic photosensitive member was produced in the same manner as in the production of the example photosensitive member 1 except that a protective layer was formed in the manner as described below.

A coating liquid for a protective layer was prepared by stirring and uniformly dispersing 2.8 parts of the charge transporting substance represented by the formula (E), 1.2 parts of the compound represented by the illustrative compound No. 16, 8 parts of the ethylene fluoride resin dispersion liquid, 3 parts of 1-propanol and 3 parts of ZEORORA H. The charge transporting layer was dip-coated to form a protective layer in the same manner as in Example 1. An example photosensitive member 12 was prepared in the manner as described above.

Example 13

An electrophotographic photosensitive member was produced in the same manner as in the production of the example photosensitive member 1 except that a protective layer was formed in the manner as described below.

A coating liquid for a protective layer was prepared by stirring and uniformly dispersing 2.8 parts of the charge transporting substance represented by the formula (E), 1.2 parts of the compound represented by the illustrative compound No. 24, 8 parts of the ethylene fluoride resin dispersion liquid, 3 parts of 1-propanol and 3 parts of ZEORORA H. The charge transporting layer was dip-coated to form a protective layer in the same manner as in Example 1. An example photosensitive member 13 was prepared in the manner as described above.

Example 14

An electrophotographic photosensitive member was produced in the same manner as in the production of the example photosensitive member 1 except that a protective layer was formed in the manner as described below.

A coating liquid for a protective layer was prepared by stirring and uniformly dispersing 2.8 parts of the charge transporting substance represented by the formula (E), 1.2 parts of the compound represented by the illustrative compound No. 31, 8 parts of the ethylene fluoride resin dispersion liquid, 3 parts of 1-propanol and 3 parts of ZEORORA H. The charge transporting layer was dip-coated to form a protective layer in the same manner as in Example 1. An example photosensitive member 14 was prepared in the manner as described above.

Example 15

An electrophotographic photosensitive member was produced in the same manner as in the production of the example photosensitive member 1 except that a protective layer was formed in the manner as described below.

A coating liquid for a protective layer was prepared by stirring and uniformly dispersing 2.8 parts of the charge transporting substance represented by the formula (E), 1.2 parts of the compound represented by the illustrative compound No. 37, 8 parts of the ethylene fluoride resin dispersion liquid, 3 parts of 1-propanol and 3 parts of ZEORORA H. The charge transporting layer was dip-coated to form a protective layer in the same manner as in Example 1. An example photosensitive member 15 was prepared in the manner as described above.

Example 16

An electrophotographic photosensitive member was produced in the same manner as in the production of the example photosensitive member 1 except that a protective layer was formed in the manner as described below.

A coating liquid for a protective layer was prepared by stirring and uniformly dispersing 3.2 parts of the charge transporting substance represented by the formula (E), 0.8 parts of the compound represented by the illustrative compound No. 51, 8 parts of the ethylene fluoride resin dispersion liquid, 3 parts of 1-propanol and 3 parts of ZEORORA H. The charge transporting layer was dip-coated to form a protective layer in the same manner as in Example 1. An example photosensitive member 16 was prepared in the manner as described above.

Example 17

The same undercoat layer as in Example 1 was formed on the same aluminum cylinder as in Example 1.

Subsequently, an oxytitanium phthalocyanine crystal (charge generating substance) of a crystal form having a peak at a Bragg angle $2\theta \pm 0.2°$ of 27.2° in CuKα characteristic X-ray diffraction was prepared. In a sand mill with a glass bead having a diameter of 1 mm, 2 parts of the oxytitanium phthalocyanine crystal, 1 part of polyvinyl butyral (trade name: S-LEC BM-S, manufactured by Sekisui Chemical Co., Ltd.) and 50 parts of cyclohexanone were placed and were subjected to dispersion treatment for 4 hours. Thereafter, 40 parts of ethyl acetate was added thereto to prepare a coating liquid for a charge generating layer. The undercoat layer was dip-coated with the coating liquid for a charge generating layer and a coating film obtained was dried at 80° C. for 10 minutes to form a charge generating layer having a film thickness of 0.18 μm. A charge transporting layer being the same as in Example 1 was formed on the charge generating layer.

A coating liquid for a protective layer was prepared by stirring and uniformly dispersing 2 parts of a charge transporting substance represented by the following formula (G), 2 parts of the compound represented by the illustrative compound No. 25, 0.3 parts of 1-hydroxycyclohexyl phenyl ketone as a photoinitiator and 24 parts of tetrahydrofuran. The charge transporting layer was spray-coated and a coating film was dried at 45° C. for 10 minutes and then subjected to photocuring treatment under the following conditions.

Under an atmosphere of an oxygen concentration of 6000 to 8000 ppm, the aluminum cylinder having a coating film of the coating liquid for a protective layer was rotated at a speed of 100 rpm and was irradiated with light using a metal halide lamp of 160 W/cm$^2$ output under conditions of an irradiation distance of 100 mm, an irradiation intensity of 600 mW/cm$^2$ and an irradiation time of 2 minutes. After the light irradiation, the coating film was heat-treated at 135° C. for 30 minutes to form a protective layer having a film thickness of 4.0 μm. An example photosensitive member 17 was prepared in the manner as described above.

(G)

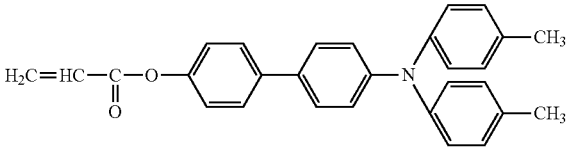

Example 18

An electrophotographic photosensitive member (example photosensitive member 18) was produced in the same manner as in the production of the example photosensitive member 1 except that a protective layer was formed in the manner as described below.

A coating liquid for a protective layer was prepared by stirring and uniformly dispersing 2 parts of the charge transporting substance represented by the formula (G), 2 parts of the compound represented by the illustrative compound No. 36 and 24 parts of tetrahydrofuran. A protective layer similar to the protective layer in Example 17 was formed by conducting coating, photocuring and heat treatment in the same manner as in Example 17.

Comparative Example 1

A protective layer was formed in the manner as described below. The amount of the charge transporting substance represented by the formula (E) was changed to 4.2 parts and the amount of the compound represented by the following comparative compound No. 1 was changed to 1.8 parts. An electrophotographic photosensitive member (comparative example photosensitive member 1) was produced in the same manner as in the production of the example photosensitive member 1 excluding the above changes.

Comparative Compound No. 1

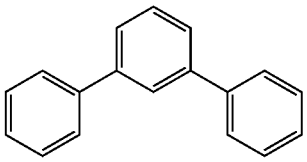

Comparative Example 2

A protective layer was formed in the manner as described below. The amount of the charge transporting substance represented by the formula (E) was changed to 4.2 parts and the amount of the compound represented by the following comparative compound No. 2 was changed to 1.8 parts. An electrophotographic photosensitive member (comparative example photosensitive member 2) was produced in the same manner as in the production of the example photosensitive member 1 excluding the above changes.

Comparative Compound No. 2

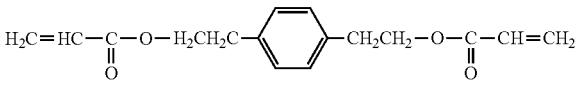

Comparative Example 3

A protective layer was formed in the manner as described below. The amount of the charge transporting substance represented by the formula (E) was changed to 4.2 parts and the amount of the compound represented by the following comparative compound No. 3 was changed to 1.8 parts. An electrophotographic photosensitive member (comparative example photosensitive member 3) was produced in the same manner as in the production of the example photosensitive member 1 excluding the above changes.

Comparative Compound No. 3

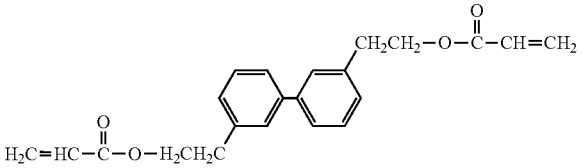

Comparative Example 4

A protective layer was formed in the manner as described below. The amount of the charge transporting substance represented by the formula (E) was changed to 4.2 parts and the amount of the compound represented by the following comparative compound No. 4 was changed to 1.8 parts. An electrophotographic photosensitive member (comparative example photosensitive member 4) was produced in the same manner as in the production of the example photosensitive member 1 excluding the above changes.

Comparative Compound No. 4

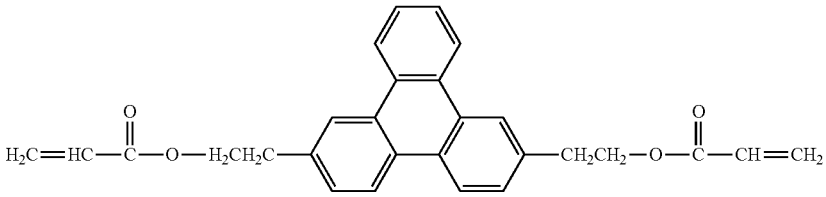

Comparative Example 5

A protective layer was formed in the manner as described below. The amount of the charge transporting substance represented by the formula (E) was changed to 4.2 parts and the amount of the compound represented by the following comparative compound No. 5 was changed to 1.8 parts. An electrophotographic photosensitive member (comparative example photosensitive member 5) was produced in the same manner as in the production of the example photosensitive member 1 excluding the above changes.

Comparative Compound No. 5

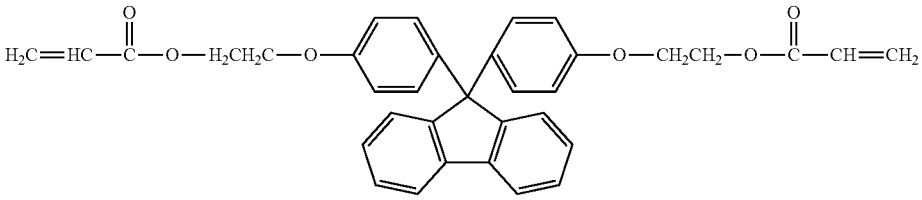

Comparative Example 6

An electrophotographic photosensitive member (comparative example photosensitive member 6) was produced in the same manner as in the production of the example photosensitive member 1 except that a protective layer was formed in the manner as described below.

A coating liquid for a protective layer was prepared by mixing 2 parts of the charge transporting substance represented by the formula (G), 2 parts of trimethylolpropane triacrylate, 0.3 parts of 1-hydroxycyclohexyl phenyl ketone as a polymerization initiator and 24 parts of tetrahydrofuran. A protective layer was prepared using the coating liquid for a protective layer in the same manner as in Example 17.

<Evaluation: Sensitivity and Residual Potential>

Evaluation of sensitivity and residual potential was conducted for the prepared example photosensitive members 1 to 18 and comparative example photosensitive members 1 to 6 under the following conditions.

First, using a photosensitive member testing apparatus (trade name: CYNTHIA 59, manufactured by GEN-TECH, INC.), charge apparatus conditions were set so that the surface of the electrophotographic photosensitive members might have a potential of −700 V under an environment of a temperature of 23° C./50% RH. The surface of each electrophotographic photosensitive member was irradiated with monochromatic light having a wavelength of 780 nm and the amount of light needed to reduce the potential from −700V to −200V was measured to determine sensitivity ($\mu J/cm^2$). Further, the potential of each photosensitive member, when irradiated in a light amount of 20 ($\mu J/cm^2$), was measured to determine residual potential (V).

<Evaluation: Memory under Charger>

Evaluation of image defects, particularly memory under a charger, was conducted using the prepared example photosensitive members 1 to 18 and comparative example photosensitive members 1 to 6 in the following manner.

As an evaluation apparatus, a copying machine, imagePRESS C1+II (corona charging system) manufactured by Canon Inc., was used. An image having a printing rate of 5% was used for feeding 100000 sheets of A4 size plain paper. A charger was then taken out from this copying machine.

Another copying machine (imagePRESS C1+II) was prepared and the charger thereof was replaced with the charger which had used 100000 sheets and an electrophotographic photosensitive member produced was installed. Under an environment of a temperature of 23° C. and a humidity of 5% RH, an image having a printing rate of 5% was used for feeding 5000 sheets of A4 size plain paper, and thereafter electric power supply to the copying machine was completely stopped to suspend operation for 15 hours. Electric power supply to the copying machine was restarted 15 hours later and a halftone image composed of one-dot keima (knight of Japanese chess) patterns was output on A3 size plain paper using cyan color alone. The amount of light was set so that the halftone density measured with a spectral densitometer, X-Rite 504 (manufactured by X-Rite Inc.), might be 0.85. For the halftone image, the densities at a portion which had been faced to the charger and at a portion which had not been faced to the charger were measured at X-Rite. The density difference is shown in Table 2. In the present invention, the density difference of less than 0.1 was determined that an effect of the present invention was obtained. On the other hand, the density difference of 0.1 or more was determined that an effect of the present invention was not obtained.

The evaluation rank was set as follows.

Rank 5: density difference is not recognized in the halftone.

Rank 4: minor density difference can be seen in the halftone.

Rank 3: slight density difference in the halftone can be seen although the density difference is less than 0.1.

Rank 2: density difference of 0.1 or more can be seen in the halftone.

Rank 1: density difference of 0.2 or more can be seen in the halftone.

<Evaluation: Evaluation of Potential Variation and Wear Amount>

Wear amount of a protective layer was conducted using the produced example photosensitive members 1 to 18 and comparative example photosensitive members 1 to 6 under the following conditions.

As an electrophotographic apparatus, a copying machine, iR ADVANCE C9280 manufactured by Canon Inc., was used.

First, the initial film thickness of the protective layer of each electrophotographic photosensitive member was measured using an interference thickness meter (trade name: MCPD-3700, manufactured by Otsuka Electronics Co., Ltd.). Subsequently, the electrophotographic apparatus and the electrophotographic photosensitive members were left to stand in an environment of a temperature of 23° C. and a humidity of 50% RH for 24 hours or longer and thereafter each electrophotographic photosensitive member was installed in a black cartridge of the electrophotographic apparatus.

Subsequently, an image having a printing rate of 5% was output on A4 size plain paper using black color alone to output 500000 sheets continuously.

The photosensitive member was installed in the photosensitive member testing apparatus again, charging apparatus conditions were set so that the surface of the electrophotographic photosensitive member has a potential of −700 V and light irradiation was conducted in the same amount of light as the initial amount of light to read bright part potential. The difference between the bright part potential and the initial bright part potential was evaluated as a potential variation value.

Subsequently, the electrophotographic photosensitive member was taken out from the electrophotographic apparatus and the film thickness of the protective layer after the output of 500000 sheets were measured to calculate the difference in the film thickness of the protective layer between before and after the output of 500000 sheets (namely, wear amount). The evaluation results obtained are shown in Table 2.

The ratio (%) of the amount added in Table 2 represents the ratio (%) of the mass of the polymerizable compound according to the present invention or the ratio (%) of the mass of the comparative compound to the total amount of the polymerizable functional group-containing charge transporting substance and the polymerizable compound according to the present invention or comparative compound each contained in the surface layer.

TABLE 2

| | Polymerizable compound No. | Ratio (%) of amount added | Evaluation results of photosensitive member: Sensitivity [μJ/cm$^2$] | Residual potential [−V] | Evaluation of memory under charger | Potential variation after durability test [V] | Wear amount [μm] |
|---|---|---|---|---|---|---|---|
| Example 1 | Illustrative compound No. 9 | 40 | 0.23 | 57 | 5 | 42 | 0.5 |
| Example 2 | Illustrative compound No. 9 | 30 | 0.23 | 54 | 4 | 40 | 0.5 |
| Example 3 | Illustrative compound No. 9 | 20 | 0.22 | 50 | 3 | 38 | 0.6 |
| Example 4 | Illustrative compound No. 13 | 30 | 0.23 | 52 | 5 | 41 | 0.5 |
| Example 5 | Illustrative compound No. 49 | 30 | 0.23 | 53 | 4 | 43 | 0.5 |
| Example 6 | Illustrative compound No. 10 | 40 | 0.23 | 47 | 5 | 38 | 0.5 |
| Example 7 | Illustrative compound No. 21 | 20 | 0.23 | 50 | 4 | 39 | 0.5 |
| Example 8 | Illustrative compound No. 25 | 30 | 0.23 | 55 | 4 | 44 | 0.4 |
| Example 9 | Illustrative compound No. 43 | 30 | 0.23 | 49 | 4 | 39 | 0.6 |
| Example 10 | Illustrative compound No. 9 | 40 | 0.23 | 62 | 5 | 40 | 0.6 |
| Example 11 | Illustrative compound No. 9 | 30 | 0.23 | 58 | 4 | 36 | 0.5 |
| Example 12 | Illustrative compound No. 16 | 30 | 0.23 | 52 | 5 | 38 | 0.5 |
| Example 13 | Illustrative compound No. 24 | 30 | 0.23 | 61 | 3 | 38 | 0.6 |
| Example 14 | Illustrative compound No. 31 | 30 | 0.23 | 57 | 4 | 39 | 0.5 |
| Example 15 | Illustrative compound No. 37 | 30 | 0.23 | 56 | 4 | 40 | 0.5 |
| Example 16 | Illustrative compound No. 51 | 20 | 0.23 | 59 | 3 | 40 | 0.6 |
| Example 17 | Illustrative compound No. 25 | 50 | 0.22 | 72 | 4 | 57 | 0.8 |
| Example 18 | Illustrative compound No. 36 | 50 | 0.22 | 78 | 3 | 60 | 0.8 |
| Comparative Example 1 | Comparative compound No. 1 | 30 | 0.26 | 90 | 1 | 105 | 1.4 |
| Comparative Example 2 | Comparative compound No. 2 | 30 | 0.24 | 94 | 1 | 89 | 1.1 |
| Comparative Example 3 | Comparative compound No. 3 | 30 | 0.24 | 85 | 1 | 88 | 0.8 |
| Comparative Example 4 | Comparative compound No. 4 | 30 | 0.24 | 87 | 1 | 66 | 0.8 |
| Comparative Example 5 | Comparative compound No. 5 | 30 | 0.23 | 68 | 2 | 57 | 0.7 |
| Comparative Example 6 | — | — | 0.22 | 69 | 1 | 55 | 0.7 |

From the results in Table 2, the example photosensitive members had much more satisfactory performance than comparative example photosensitive members with respect to the electrical properties, the memory under a charger and the wear resistance. The polymerizable compounds according to the present invention had satisfactory electrical properties even though the amount thereof added was increased.

With respect to the comparative example photosensitive members, the compound represented by the comparative compound No. 1 is considered not to be compatible with the protective layer because both the electrical properties and the memory under a charger were deteriorated. Moreover, the wear resistance was worsened because a polymerizable functional group is not contained. It is considered that the addition to a curable layer is not suitable. The comparative compounds No. 2 and No. 3 did not exhibit the effects of the present invention. It is considered that the main skeleton moiety was not adapted. It is considered that the conformation of the compound is fixed in the comparative compounds No. 4 and No. 5 and therefore the memory under a charger is not satisfactory.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-119059, filed Jun. 15, 2016, which is hereby incorporated by reference herein in its entirety.

What is claimed is:

1. An electrophotographic photosensitive member, comprising:

an electrically conductive support; and a photosensitive layer on the support, wherein a surface layer of the electrophotographic photosensitive member comprises a copolymer of a polymerizable functional group-containing charge transporting substance and a compound represented by formula (1):

$$\mathrm{Ar}\text{—}(\mathrm{Ln}\text{—}\mathrm{Fn})_m \tag{1}$$

where Ar is a substituted or unsubstituted aromatic hydrocarbon group and is an m-valent group obtained by eliminating m number of hydrogen atoms each bonded to a benzene ring of a compound represented by formula (2) other than from $R^1$, $R^2$ and $R^3$;

Ln represents a divalent group represented by formula (3) or formula (4);

Fn represents a polymerizable functional group; and m represents an integer of 1 to 4 and when m is equal to or larger than 2, m number of structures in parenthesis are the same or different:

(2)

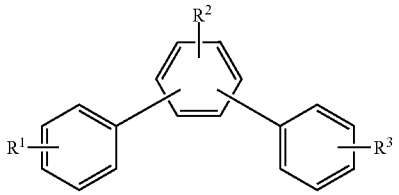

where $R^1$, $R^2$ and $R^3$ each independently represent a hydrogen atom or a substituted or unsubstituted phenyl group; and substituents on Ar, $R^1$, $R^2$ and $R^3$ are each an alkyl group having 1 to 6 carbon atoms or an alkoxy group having 1 to 6 carbon atoms:

$$\text{—}(\mathrm{R}^4)_p\text{—} \tag{3}$$

$$\text{—}(\mathrm{O}\text{—}\mathrm{R}^5)_r\text{—} \tag{4}$$

where $R^4$ represents an alkylene group having 1 to 6 carbon atoms and p represents 0 or 1; and $R^5$ represents an alkylene group having 1 to 6 carbon atoms and r represents an integer of 1 to 4.

2. The electrophotographic photosensitive member according to claim 1, wherein the compound represented by the formula (1) is represented by formula (5):

$$\mathrm{Ar}\text{—}(\mathrm{R}^4\text{—}\mathrm{Fn})_m \tag{5}$$

where $R^4$ represents an alkylene group having 1 to 6 carbon atoms.

3. The electrophotographic photosensitive member according to claim 1, wherein a number m of the polymerizable functional groups on Ar is 2 or 3.

4. The electrophotographic photosensitive member according to claim 1, wherein Ar has a structure in which one polymerizable functional group on Ar is introduced to one benzene ring.

5. The electrophotographic photosensitive member according to claim 1, wherein a ratio of a mass of the compound represented by formula (1) to a total mass of the polymerizable functional group-containing charge transporting substance and the compound represented by the formula (1) is 5 to 70% by mass.

6. The electrophotographic photosensitive member according to claim 1, wherein the polymerizable functional group is a chain polymerizable functional group.

7. The electrophotographic photosensitive member according to claim 6, wherein the chain polymerizable functional group is an acryloyloxy group or a methacryloyloxy group.

8. The electrophotographic photosensitive member according to claim 1, wherein the compound represented by the formula (1) has a molecular weight of 400 to 700.

9. An electrophotographic photosensitive member, comprising:

an electrically conductive support; and a photosensitive layer on the support, wherein a surface layer of the electrophotographic photosensitive member comprises a copolymer of a polymerizable functional group-containing charge transporting substance and a compound represented by formula (1):

$$\mathrm{Ar}\text{—}(\mathrm{Ln}\text{—}\mathrm{Fn})_m \tag{1}$$

where Ar is a substituted or unsubstituted aromatic hydrocarbon group and is an m-valent group obtained by eliminating m number of hydrogen atoms each bonded to a benzene ring of a compound represented by structural formulae Ar-1 to Ar-6:

Ar-1

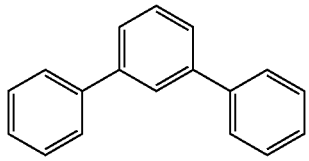

-continued

Ar-2

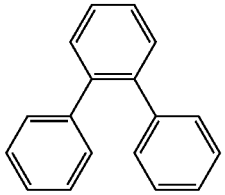

Ar-3

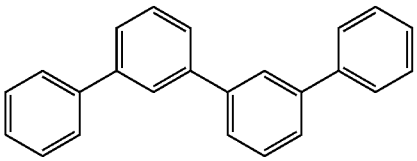

Ar-4

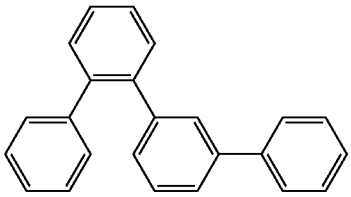

Ar-5

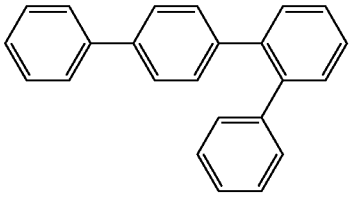

Ar-6

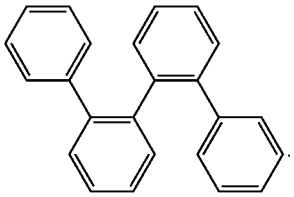

Ln represents a divalent group represented by formula (3) or formula (4);

Fn represents a polymerizable functional group; and m represents an integer of 1 to 4 and when m is equal to or larger than 2, m number of structures in parenthesis are the same or different:

the benzene rings of formulae Ar-1 to Ar-6 are each independently optionally substituted with $R^1$, where $R^1$ independently represents a hydrogen atom or a substituted or unsubstituted phenyl group; and substituents on Ar and $R^1$ are independently each an alkyl group having 1 to 6 carbon atoms or an alkoxy group having 1 to 6 carbon atoms:

$$-(R^4)_p- \quad (3)$$

$$-(O-R^5)_r- \quad (4)$$

where $R^4$ represents an alkylene group having 1 to 6 carbon atoms and p represents 0 or 1; and $R^5$ represents an alkylene group having 1 to 6 carbon atoms and r represents an integer of 1 to 4.

10. The electrophotographic photosensitive member according to claim 9, wherein the compound represented by the formula (1) has a molecular weight of 400 to 700.

11. The electrophotographic photosensitive member according to claim 9, wherein the compound represented by the formula (1) is represented by formula (5):

$$Ar-(R^4-Fn)_m \quad (5)$$

where $R^4$ represents an alkylene group having 1 to 6 carbon atoms.

12. The electrophotographic photosensitive member according to claim 9, wherein a number m of the polymerizable functional groups on Ar is 2 or 3.

13. The electrophotographic photosensitive member according to claim 9, wherein Ar has a structure in which one polymerizable functional group on Ar is introduced to one benzene ring.

14. The electrophotographic photosensitive member according to claim 9, wherein a ratio of a mass of the compound represented by formula (1) to a total mass of the polymerizable functional group-containing charge transporting substance and the compound represented by the formula (1) is 5 to 70% by mass.

15. The electrophotographic photosensitive member according to claim 9, wherein the polymerizable functional group is a chain polymerizable functional group.

16. The electrophotographic photosensitive member according to claim 15, wherein the chain polymerizable functional group is an acryloyloxy group or a methacryloyloxy group.

17. A process cartridge integrally supporting: an electrophotographic photosensitive member comprising an electrically conductive support and a photosensitive layer on the support; and at least one unit selected from the group consisting of a charging unit, a developing unit and a cleaning unit, the process cartridge detachably attachable to an electrophotographic apparatus main body, wherein a surface layer of the electrophotographic photosensitive member comprises a copolymer of a polymerizable functional group-containing charge transporting substance and a compound represented by formula (1):

$$Ar-(Ln-Fn)_m \quad (1)$$

where Ar is a substituted or unsubstituted aromatic hydrocarbon group and is an m-valent group obtained by eliminating m number of hydrogen atoms each bonded to a benzene ring of a compound represented by formula (2) other than from $R^1$, $R^2$ and $R^3$;

Ln represents a divalent group represented by formula (3) or formula (4);

Fn represents a polymerizable functional group; and m represents an integer of 1 to 4 and when m is equal to or larger than 2, m number of structures in parenthesis are the same or different:

(2)

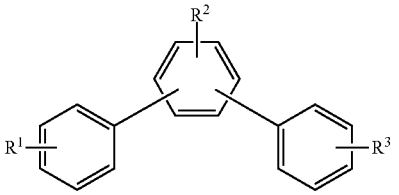

where $R^1$, $R^2$ and $R^3$ each independently represent a hydrogen atom or a substituted or unsubstituted phenyl group; and substituents on Ar, $R^1$, $R^2$ and $R^3$ are each an alkyl group having 1 to 6 carbon atoms or an alkoxy group having 1 to 6 carbon atoms:

(3)

$$-(R^4)_p-$$

(4)

$$-(O-R^5)_r-$$

where $R^4$ represents an alkylene group having 1 to 6 carbon atoms and p represents 0 or 1; and $R^5$ represents an alkylene group having 1 to 6 carbon atoms and r represents an integer of 1 to 4.

18. An electrophotographic apparatus, comprising:

an electrophotographic photosensitive member comprising an electrically conductive support and a photosensitive layer on the support;

a charging unit;

an exposing unit;

a developing unit; and a transfer unit, wherein a surface layer of the electrophotographic photosensitive member comprises a copolymer of a polymerizable functional group-containing charge transporting substance and a compound represented by formula (1):

(1)

$$Ar-(Ln-Fn)_m$$

where Ar is a substituted or unsubstituted aromatic hydrocarbon group and is an m-valent group obtained by eliminating m number of hydrogen atoms each bonded to a benzene ring of a compound represented by formula (2) other than from $R^1$, $R^2$ and $R^3$;

Ln represents a divalent group represented by formula (3) or formula (4);

Fn represents a polymerizable functional group; and m represents an integer of 1 to 4 and when m is equal to or larger than 2, m number of structures in parenthesis are the same or different:

(2)

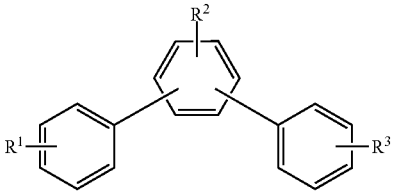

where $R^1$, $R^2$ and $R^3$ each independently represent a hydrogen atom or a substituted or unsubstituted phenyl group; and substituents on Ar, $R^1$, $R^2$ and $R^3$ are each an alkyl group having 1 to 6 carbon atoms or an alkoxy group having 1 to 6 carbon atoms:

(3)

$$-(R^4)_p-$$

(4)

$$-(O-R^5)_r-$$

where $R^4$ represents an alkylene group having 1 to 6 carbon atoms and p represents 0 or 1; and $R^5$ represents an alkylene group having 1 to 6 carbon atoms and r represents an integer of 1 to 4.

19. A process for producing an electrophotographic photosensitive member comprising: an electrically conductive support; and a photosensitive layer on the support, the process comprising polymerizing a coating film of a coating liquid prepared by mixing a polymerizable functional group-containing charge transporting substance and a compound represented by formula (1), thereby forming a surface layer of the electrophotographic photosensitive member:

(1)

$$Ar-(Ln-Fn)_m$$

where Ar is a substituted or unsubstituted aromatic hydrocarbon group and is an m-valent group obtained by eliminating m number of hydrogen atoms each bonded to a benzene ring of a structure represented by formula (2) other than from $R^1$, $R^2$ and $R^3$;

Ln represents a divalent group represented by formula (3) or formula (4);

Fn represents a polymerizable functional group; and m represents an integer of 1 to 4 and when m is equal to or larger than 2, m number of structures in parenthesis are the same or different:

(2)

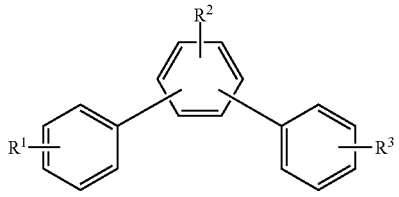

where $R^1$, $R^2$ and $R^3$ each independently represent a hydrogen atom or a substituted or unsubstituted phenyl group; and substituents on Ar, $R^1$, $R^2$ and $R^3$ are each an alkyl group having 1 to 6 carbon atoms or an alkoxy group having 1 to 6 carbon atoms:

(3)

$$-(R^4)_p-$$

(4)

$$-(O-R^5)_r-$$

where $R^4$ represents an alkylene group having 1 to 6 carbon atoms and p represents 0 or 1; and $R^5$ represents an alkylene group having 1 to 6 carbon atoms and r represents an integer of 1 to 4.

* * * * *